US011136170B2

(12) United States Patent
Faerber et al.

(10) Patent No.: US 11,136,170 B2
(45) Date of Patent: Oct. 5, 2021

(54) CONTAINER LID WITH BUTTON RELEASE AND LOCK

(71) Applicant: RUNWAY BLUE, LLC, Alpine, UT (US)

(72) Inventors: Paul James Faerber, Pleasant Grove, UT (US); Jim Allen Colby, Highland, UT (US); John R. Omdahl, II, Lindon, UT (US); David O. Meyers, East Layton, UT (US); Joseph O. Jacobsen, American Fork, UT (US); Steven M Sorensen, Alpine, UT (US)

(73) Assignee: Runway Blue, LLC, Alpine, UT (US)

( * ) Notice: Subject to any disclaimer, the term of this patent is extended or adjusted under 35 U.S.C. 154(b) by 213 days.

(21) Appl. No.: 16/408,132

(22) Filed: May 9, 2019

(65) Prior Publication Data

US 2019/0344934 A1 Nov. 14, 2019

Related U.S. Application Data

(60) Provisional application No. 62/669,882, filed on May 10, 2018.

(51) Int. Cl.
*B65D 47/08* (2006.01)
*A45F 3/16* (2006.01)
(Continued)

(52) U.S. Cl.
CPC ..... *B65D 47/0871* (2013.01); *A45F 3/16* (2013.01); *B65D 53/04* (2013.01); *B65D 55/02* (2013.01); *B65D 2251/1058* (2013.01)

(58) Field of Classification Search
CPC ..... B65D 47/08; B65D 47/0857; B65D 47/0871; B65D 47/0876; B65D 47/088;
(Continued)

(56) References Cited

U.S. PATENT DOCUMENTS 5,282,541 A * 2/1994 Chen ..... A47G 19/2266 215/12.1
8,695,830 B2 * 4/2014 Meyers ..... B65D 47/0895 220/254.3

(Continued)

FOREIGN PATENT DOCUMENTS

EP 2532601 12/2012
JP 2010241461 10/2010

OTHER PUBLICATIONS

International Search Report and the Written Opinion of the International Searching Authority for PCT Application No. PCT/US2019/031606, dated Jul. 26, 2019 (9 pgs).

*Primary Examiner* — Andrew T Kirsch
(74) *Attorney, Agent, or Firm* — Sterne, Kessler, Goldstein & Fox P.L.L.C.

(57) ABSTRACT

A container lid includes a container top, a lid opening, a closure, a push button, and a lock. The container top may be sized and configured to be attached to a container body. The lid opening may be formed in the container top. The closure may be movably coupled to the container top and may be movable between first and second positions in which the lid opening is, respectively, covered or uncovered. The push button may be configured to selectively retain the closure in the first position, and may be movable between latched and unlatched positions. The lock may be movable between locked and unlocked positions and in the locked position may be configured to inhibit movement of the push button from the latched to the unlatched position.

23 Claims, 16 Drawing Sheets

(51) Int. Cl.
*B65D 53/04* (2006.01)
*B65D 55/02* (2006.01)

(58) Field of Classification Search
CPC ..... B65D 47/0885; B65D 47/0889; B65D 47/0895; B65D 50/06; B65D 50/065; A45F 3/18
See application file for complete search history.

(56) References Cited

U.S. PATENT DOCUMENTS

| | | | | |
|---|---|---|---|---|
| 2013/0001259 | A1* | 1/2013 | Lin | B65D 47/268 222/505 |
| 2017/0057707 | A1 | 3/2017 | Lin | |
| 2017/0225849 | A1* | 8/2017 | Miros | B65B 7/2835 |
| 2017/0225850 | A1 | 8/2017 | Sorensen | |
| 2017/0297785 | A1* | 10/2017 | Maruyama | A47G 19/2272 |

* cited by examiner

CONTAINER LID WITH BUTTON RELEASE AND LOCK

CROSS-REFERENCE TO RELATED APPLICATION

This application claims the benefit of U.S. Provisional Patent Application No. 62/669,882, filed May 10, 2018, which is incorporated herein in its entirety, by reference thereto.

FIELD OF THE DISCLOSURE

The present disclosure generally relates to lids with a button release and lock.

BACKGROUND

Containers may hold a variety of different types of liquids such as water, beverages, drinks, juices, and the like. Containers also may hold various items such as energy drinks, protein drinks, shakes, foodstuffs, dressings, sauces, and liquid meal replacements.

A lid with a closure may be used to control access to an interior of the container. The lid may selectively cover an opening of the container. The closure may selectively cover a relatively smaller opening formed in the lid. The lid may be removed entirely to fill the container with ice or other contents, to wash the container, or to otherwise provide access to the interior of the container through the relatively large opening of the container. The closure may be opened to allow a user to consume contents of the container through the relatively smaller opening of the lid or to otherwise provide access to the interior of the container through the relatively smaller opening formed in the lid.

The subject matter claimed herein is not limited to embodiments that solve any disadvantages or that operate only in environments such as those described above. Rather, this background is only provided to illustrate one example technology area where some embodiments described herein may be practiced.

SUMMARY

In some embodiments of the subject disclosure, a container may hold or contain liquids, beverages, drinks, and the like. The container may allow water and other types of fluids to be transported and/or consumed. For example, the container may be used to transport or consume water, flavored waters, juices, vitamin enhanced beverages, energy drinks, thirst-quenchers and the like. In addition, the container may hold mixtures and solutions, which may include vitamins, supplements, protein powders, meal replacements, etc. Further, the container may hold various powders, solids and/or other types of materials including foodstuffs such as fruits, vegetables, soups, dressings, and the like. In some embodiments, the container may be insulated to help keep the contents at a desired temperature. The container may be a bottle, cup, vessel, or the like, and the container may have any of a variety of different shapes, sizes, configurations, and arrangements depending, for example, upon the intended use of the container.

Some aspects of the subject disclosure relate to container lids for containers. In some embodiments, the container lid may be selectively attached and/or detached from the container. The container lid may cover an opening of the container and may include a closure that covers one or more openings of the container lid. The container lid may seal the one or more openings with an air and/or fluid-tight seal, which may prevent the contents from leaking or spilling. The one or more openings may allow contents to be quickly and easily added to or removed from the container.

In an example, a container lid includes a container top, a lid opening, a closure, a push button, and a lock. The container top may be sized and configured to be attached to a container body. The lid opening may be formed in the container top. The closure may be movably coupled to the container top and may be configured to selectively cover the lid opening. The closure may be movable between a first position in which the lid opening is covered and a second position in which the lid opening is uncovered. The push button may be movably coupled to one or more of the container top and the closure and may be configured to selectively retain the closure in the first position. The push button may be movable with respect to the container top and the closure between a latched position and an unlatched position. The lock may be movably coupled to one or more of the container top and the closure between a locked position and an unlocked position. The lock in the locked position may be configured to inhibit movement of the push button from the latched position to the unlatched position.

In another example, a container includes a container body and a container lid attachable to the container body. The container lid includes a spout, a closure, a push button, and a lock. The spout may provide access to an interior of the container body. The closure may be configured to selectively seal the spout. The closure may be movable relative to the spout between a first position in which the spout is sealed and a second position in which the spout is unsealed. The push button may be configured to selectively retain the closure in the first position. The push button may be movable with respect to at least one of the spout or the closure between a latched position in which the push button holds the closure in the first position and an unlatched position in which the push button does not hold the closure in the first position. The lock may be configured to selectively inhibit operation of the push button. The lock may be movable with respect to the spout between a locked position in which operation of the push button is inhibited by the lock and an unlocked position in which operation of the push button is uninhibited by the lock.

These and other aspects, features, and advantages of the subject technology will become more fully apparent from the following brief description of the drawings, the drawings, the detailed description of preferred embodiments, and appended claims.

BRIEF DESCRIPTION OF THE DRAWINGS

The appended drawings are incorporated in and constitute a part of this description, and contain figures of certain embodiments to further disclose the above and other aspects, principles, advantages, and features of the subject technology. It will be appreciated that these drawings depict only certain embodiments and are not intended to limit the scope of the invention. Additionally, it will be appreciated that while the drawings may illustrate certain sizes, scales, relationships, and configurations of the subject technology, the drawings are not intended to limit the scope of the claimed invention.

DETAILED DESCRIPTION

The detailed description set forth below includes a description of various configurations of the subject technology and is not intended to represent the only configurations in which the subject technology may be practiced. The detailed description includes specific details for the purpose of providing a thorough understanding of the subject technology. However, the subject technology may be practiced without these specific details. In some instances, well-known structures and components are not shown, or are shown schematically, to avoid obscuring the concepts of the subject technology.

Although various aspects, principles, advantages, and features of the subject technology are disclosed herein with reference to liquid-dispensing containers or container lids, the present disclosure is not limited to liquid-dispensing containers or container lids. It will be understood that, in light of the present disclosure, the liquid-dispensing containers disclosed herein may have a variety of suitable shapes, sizes, configurations, and arrangements. It will also be understood that containers and container lids according to the subject technology may include any suitable number of parts and components, such as vessels, selectors, valve bodies, nozzles, lid bodies, straws, and the like; and the containers and container lids may include any appropriate number and combination of features, parts, aspects, and the like. The disclosed components may be combined or subdivided in some embodiments of the subject technology. In addition, while the accompanying figures illustrate containers and container lids having particular styles and configurations, it will be appreciated that the claimed subject matter may not be limited to the illustrated styles and configurations. Further, the containers and container lids may be successfully used in connection with other types of devices.

Various exemplifying embodiments are shown in the accompanying figures. To assist in the description of the various exemplifying embodiments, words such as top, bottom, front, rear, sides, right, left, and/or variations thereof may be used to describe the accompanying figures which may be, but are not necessarily, drawn to scale. It will further be appreciated that the containers may be disposed in a variety of desired positions or orientations, and used in numerous locations, environments, and arrangements.

Some container lids include a lid opening and a closure to close the lid opening. Some such container lids include a push button that is operable to release the closure to open the lid opening. Inadvertent operation of the push button may inadvertently open the closure, which may result in accidental outflow of contents through the lid opening. Thus, some embodiments described herein may provide a lock to inhibit inadvertent operation of the push button.

Figure 1A:
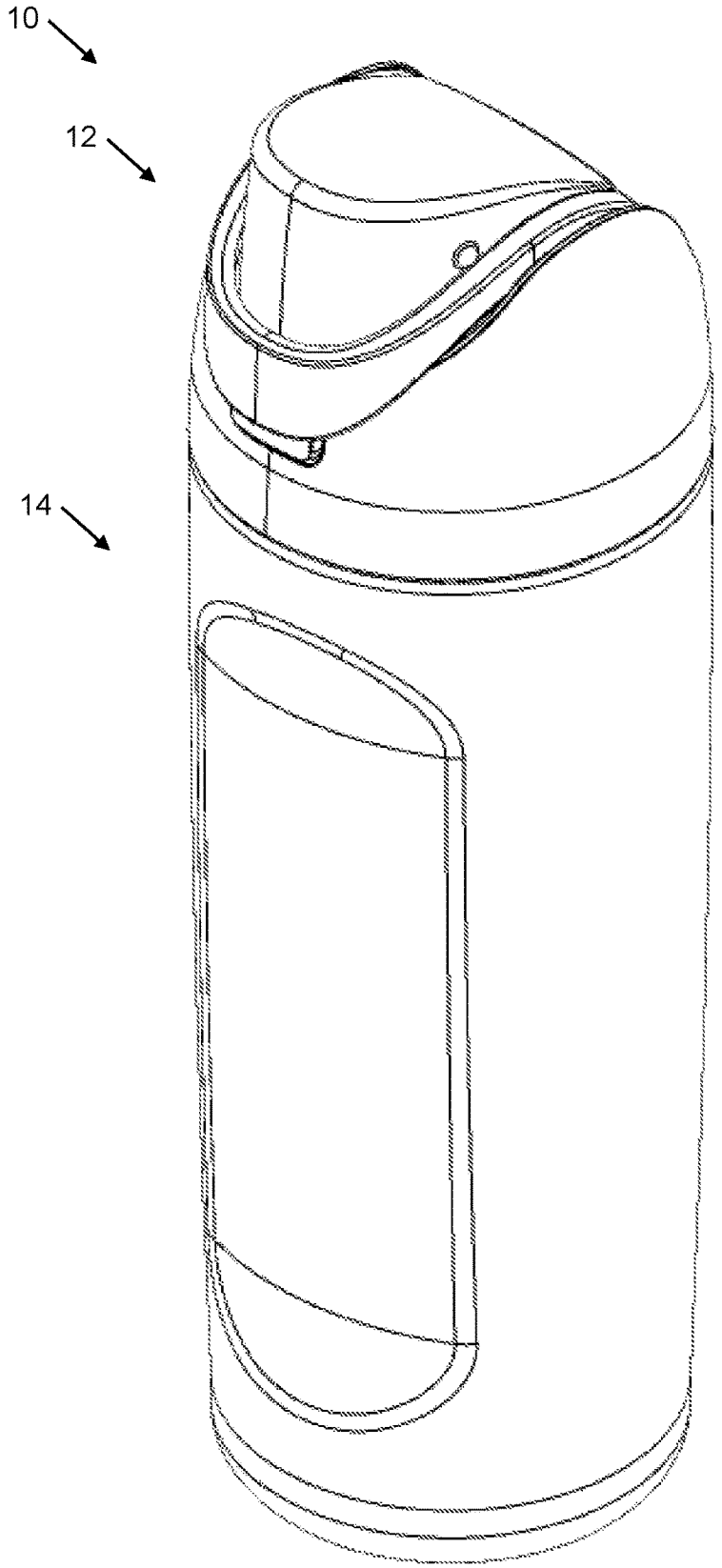
FIGS. 1A-1C respectively include an upper front perspective view, an upper rear perspective view, and an exploded upper front perspective view of an example container, in accordance with at least one embodiment.
Figure 1B:
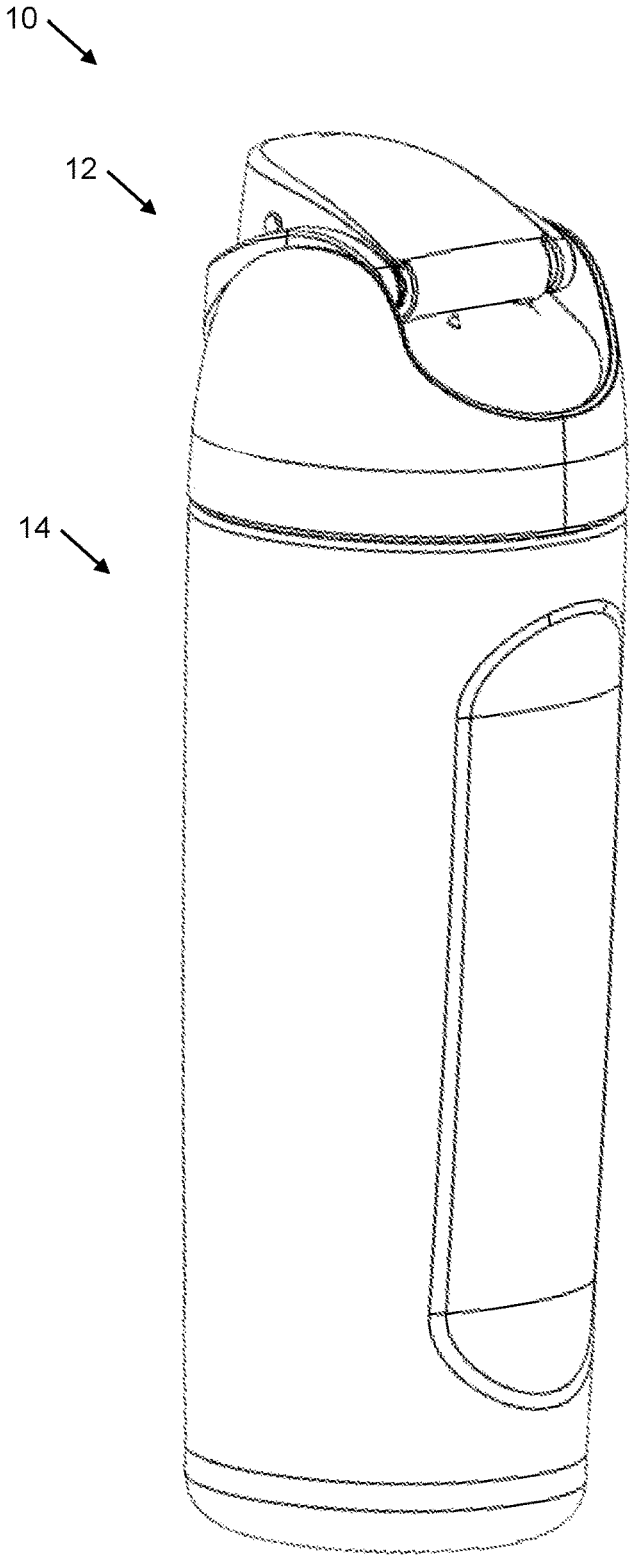
Figure 1C:
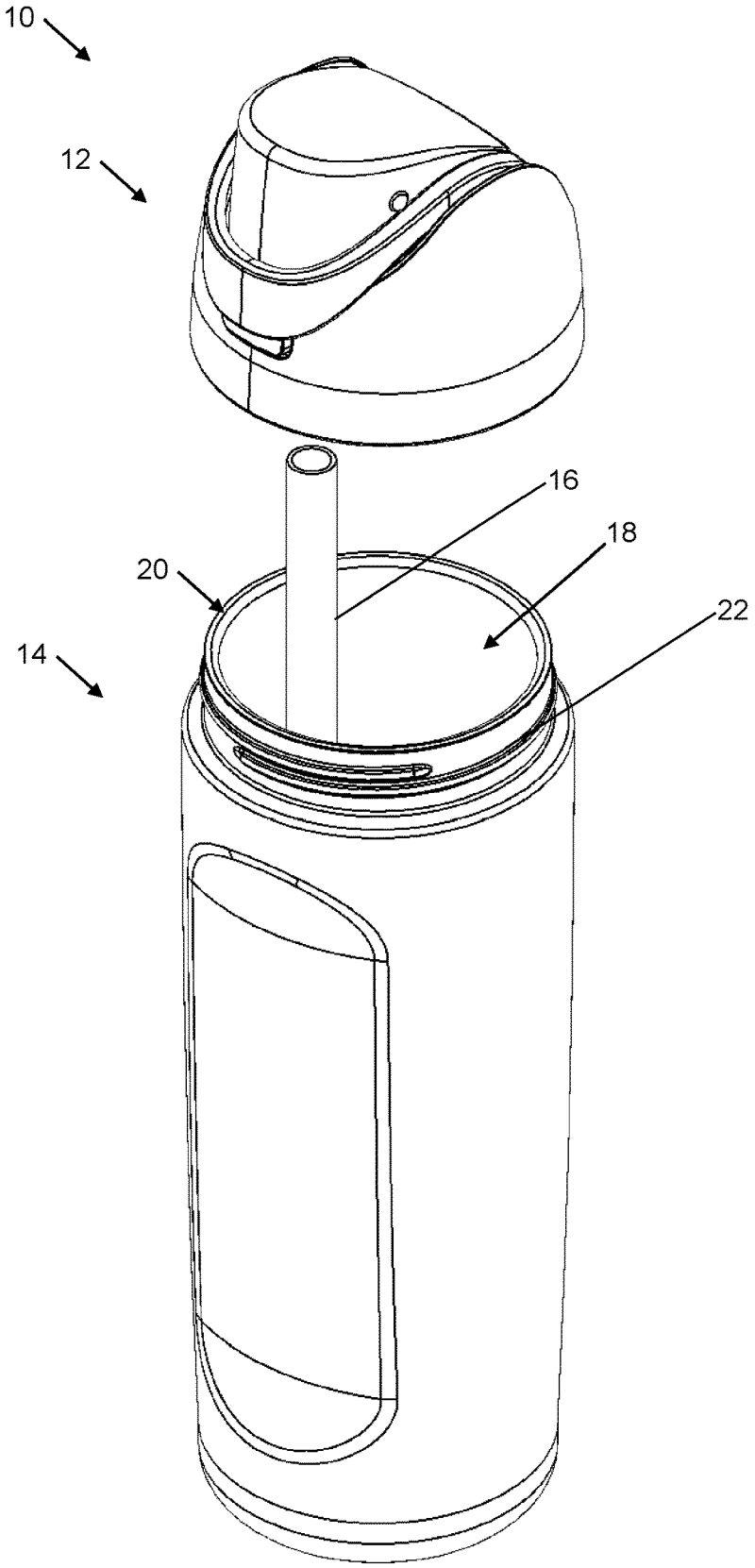

FIGS. 1A-1C respectively include an upper front perspective view, an upper rear perspective view, and an exploded upper front perspective view of an example container 10, in accordance with at least one embodiment described herein. As illustrated, the container 10 may include a container lid 12 and a container body 14. Optionally, the container 10 may additionally include a straw 16 (FIG. 1C). The container body 14 may be sized and shaped to hold, retain and/or store one or more liquids and/or solids, generally referred to herein as contents.

The container lid 12 may cooperate with the container body 14 to secure contents such as liquids within the container body 14, e.g., within an interior 18 (FIG. 1C) of the container body 14. The container lid 12 may be removed entirely from the container body 14 to expose a top opening 20 (FIG. 1C) of the container body 14 through which the interior 18 of the container body 14 may be accessed, e.g., to add contents to the container 10, to remove contents from the container 10, to wash the interior 18 of the container body 14, or to otherwise access the interior 18 of the container body 14.

The container lid 12 may define one or more lid openings (see, e.g., FIGS. 2B and 3A) that may be relatively small, e.g., smaller than the top opening 20 of the container body 14, and through which the interior 18 of the container body 14 may be accessed. For example, a user may consume the contents of the container 10 through the one or more lid openings (e.g., lid openings 50, see FIG. 3A) of the container lid 12, dispense a powdered drink mix into the container 10 through the one or more lid openings, or otherwise access the interior 18 of the container body 14 through the one or more lid openings of the container lid 12.

The container lid 12 may be selectively connected to the container body 14. For example, the container lid 12 may be selectively connected to the container body 14 by threading, snapping, twisting, sliding, or screwing the container lid 12 to the container body 14. For example, an upper portion of the container body 14 may include one or more exterior or interior threads 22 (FIG. 1C) and a lower portion of the container lid 12 may include one or more corresponding threads 48 (FIG. 3B). The threads 22 and the threads 48 may mate to allow the container lid 12 to be selectively connected to the container body 14. The threaded connection of the container lid 12 to the container body 14 may create a secure, airtight, watertight and/or leak-proof seal. The threaded connection may require multiple turns or a single turn or less to securely connect the container body 14 and the container lid 12. More generally, the container body 14 and the container lid 12 may be connected by any suitable number of turns, including a fraction of one or more turns.

The container body 14 and the container lid 12 may also be connected using other suitable types of connections and structures depending, for example, upon the intended use of container 10.

Figure 2A:
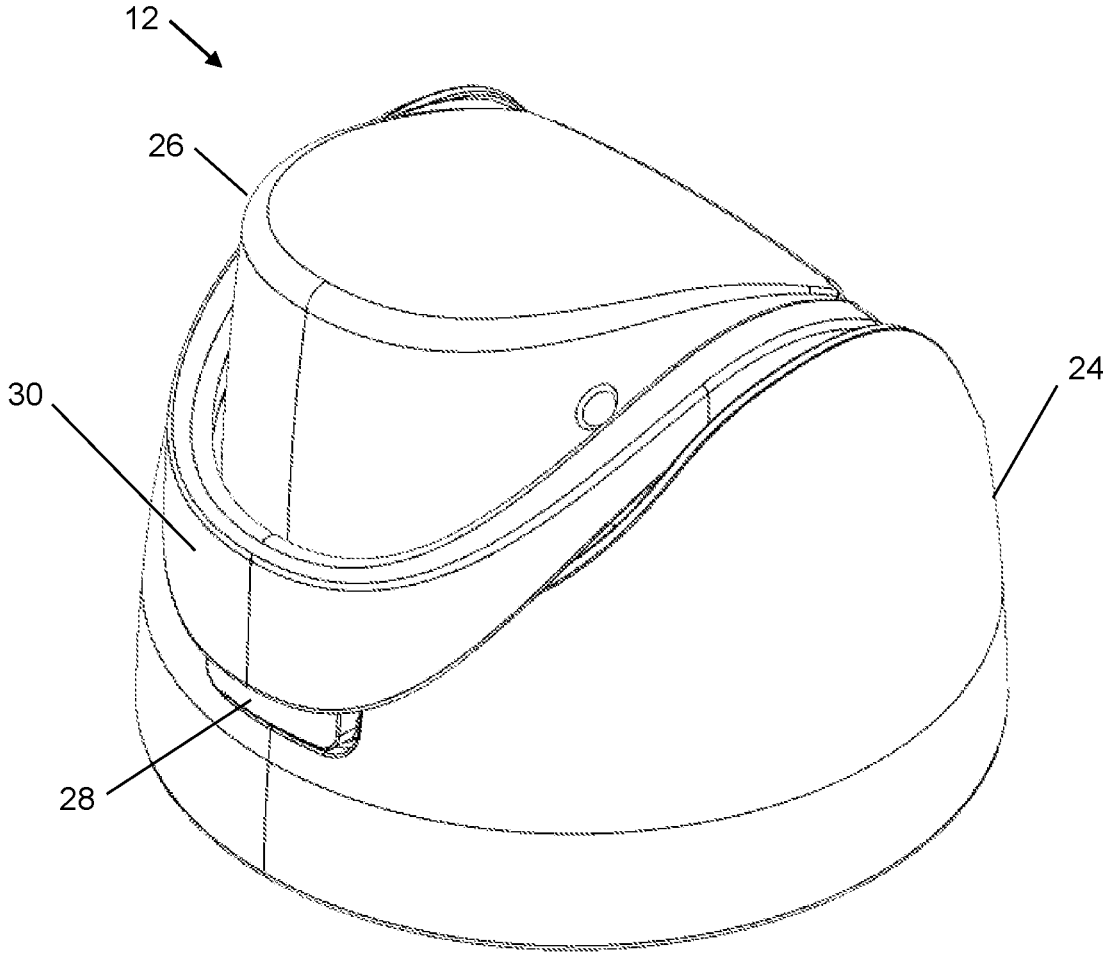
FIGS. 2A and 2B include an upper front perspective view and an exploded upper front perspective view of a container lid of the container of FIGS. 1A-1C.
Figure 2B:
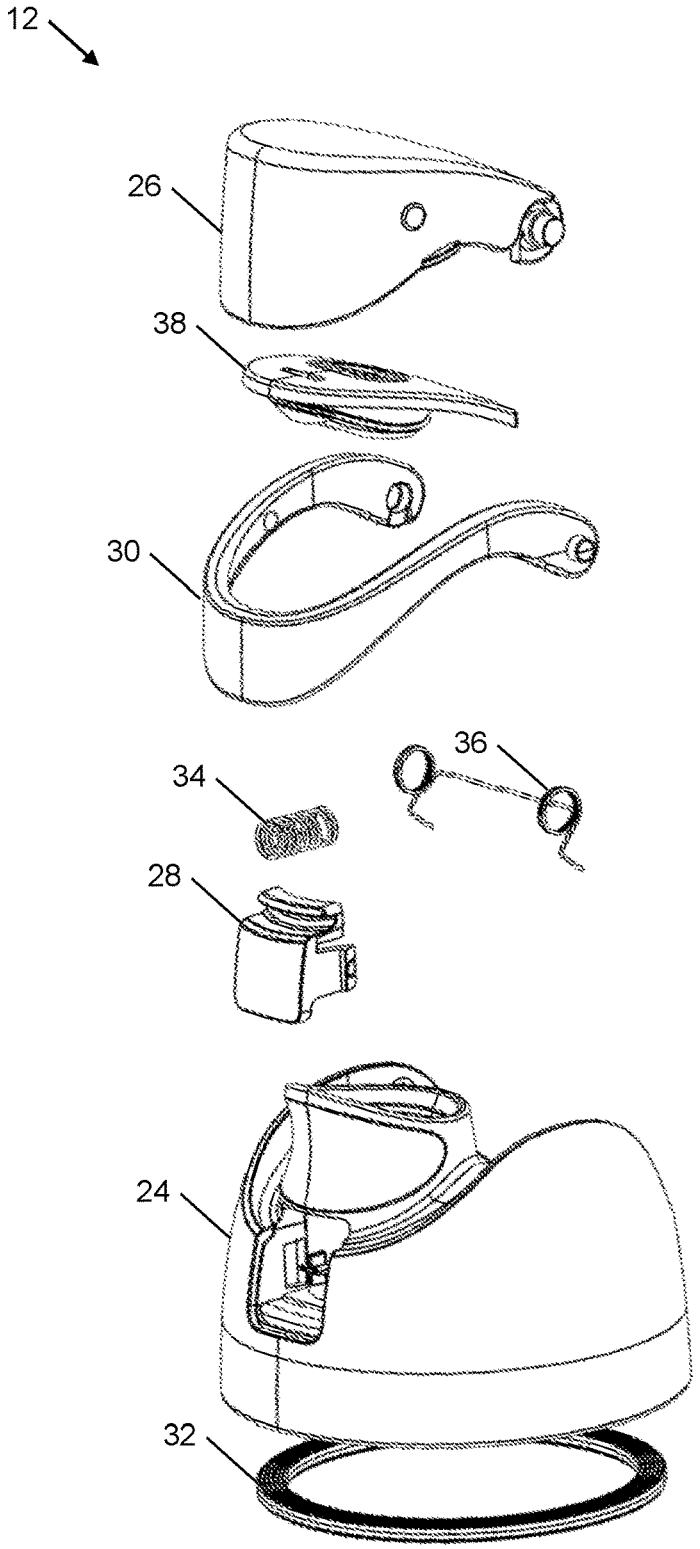

FIGS. 2A and 2B include an upper front perspective view and an exploded upper front perspective view of the container lid 12, in accordance with at least one embodiment described herein. As illustrated in FIGS. 2A and 2B, the container lid 12 may include a container top 24, a closure 26, a push button 28, and a lock 30. Optionally, the container lid 12 may additionally include one or more of a lid seal 32, a button bias member 34, a closure bias member 36, and a lid opening seal 38.

Figure 3A:
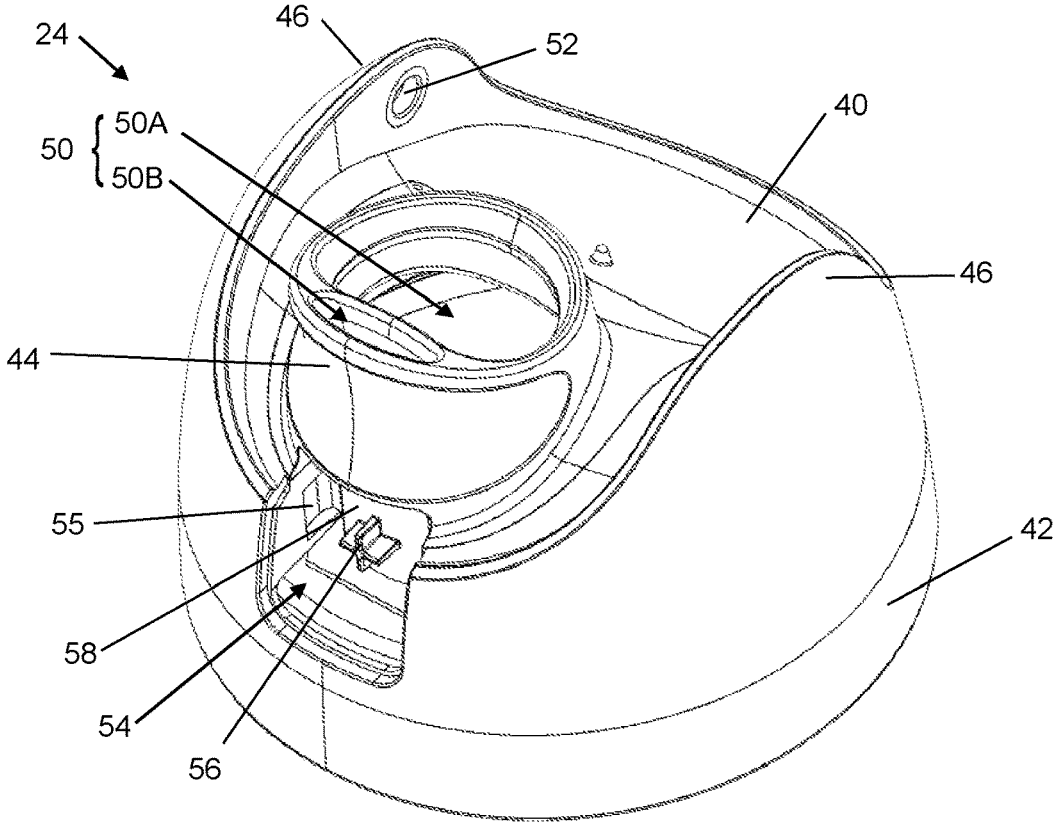
FIGS. 3A and 3B include an upper front perspective view and a lower front perspective view of a container top of the container lid of FIGS. 2A and 2B.
Figure 3B:
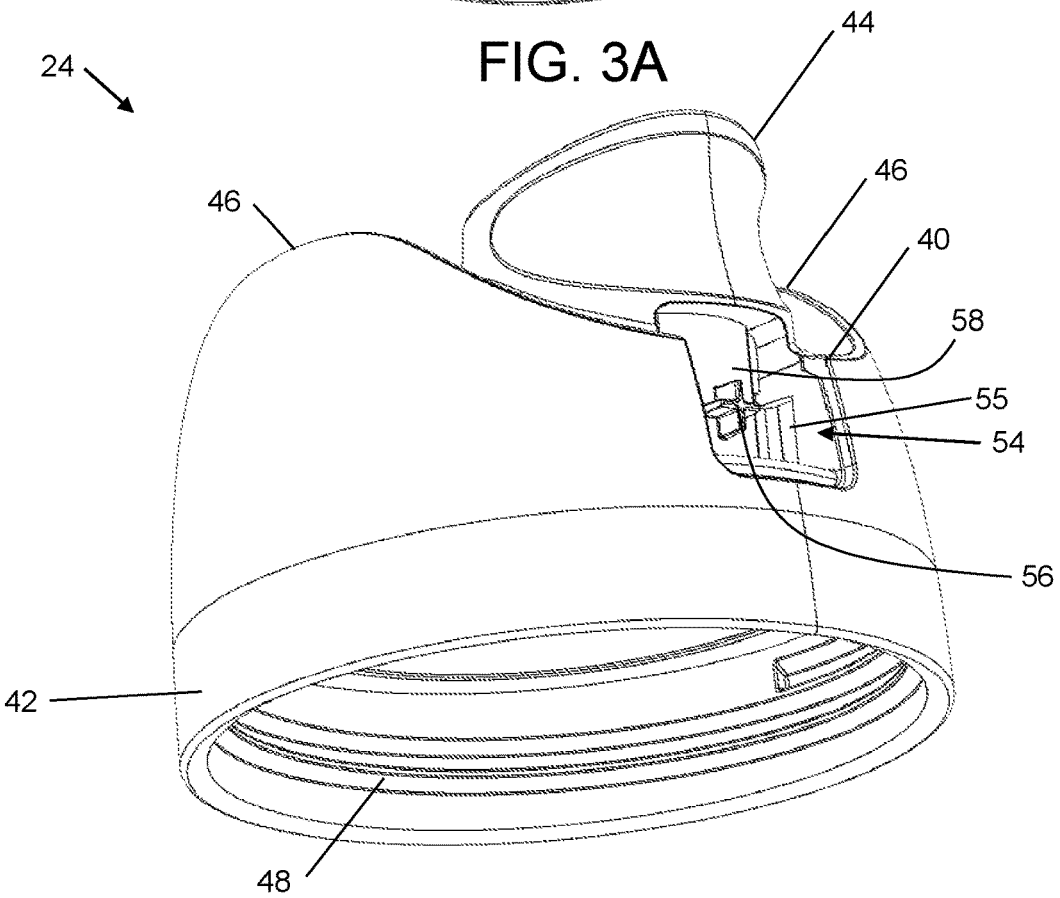

FIG. 3A includes an upper front perspective view, and FIG. 3B includes a lower front perspective view of the container top 24, in accordance with at least one embodiment described herein. The container top 24 may include an end wall 40, a skirt 42, a spout 44 and/or one or more pivot mounts 46. The skirt 42 may generally extend downward from the end wall 40 and may be configured to matingly engage a top of the container body 14. In this and other embodiments, the skirt 42 may include on an interior or exterior surface thereof one or more container engagement members to selectively secure the container top 24 to the container body 14. For example, the skirt 42 may include one or more interior threads 48, one or more exterior threads, a bayonet-style mount, or one or more other container engagement members configured to matingly engage with one or more corresponding threads, bayonet-style mounts, or other lid engagement members formed on an upper exterior or interior surface of the container body 14 to secure the container top 24 to the container body 14.

The spout 44 may extend upward from the end wall 40. Lid openings 50A, 50B (collectively "lid openings 50") may pass through the spout 44 and/or the container top 24. More generally, the spout 44 may define one or more lid openings. Two lid openings 50 of unequal size, with one positioned in front of the other, are depicted in FIG. 3A as an example. In other embodiments, the spout 44 may define a single opening or two or more openings, each opening having any suitable size and/or shape. When the container lid 12 is coupled to the container body 14 and the closure 26 is moved to uncover the spout 44, a user may consume or otherwise remove contents from the container 10 through one or more of the lid openings 50. For example, the straw 16 (FIG. 1C) may be in fluid communication with the opening 50B and the user may consume or otherwise remove contents from the container 10 by sucking on the opening 50B. As another example, the user may tip, at least partially invert, and/or squeeze the container body 14 to consume or otherwise remove contents from the container 10 through the opening 50A. Alternatively or additionally, the user may add contents to the container 10 through one or more of the lid openings 50.

Each of the pivot mounts 46 may define an opening 52 (only one is visible in FIG. 3A), discussed in more detail below. In some embodiments, the openings 52 may form recesses, as shown in FIG. 3A. In such embodiments the openings 52 may be inset from their surrounding surfaces on the pivot mounts 46, without extending entirely through the pivot mounts 46. In other examples, the openings 52 may form holes that extend entirely through the pivot mounts 46.

The container top 24 may further include a push button recess 54 with cavities 55 defined in opposing lateral sides of the push button recess 54. The push button recess 54 may be sized and configured to receive and retain therein at least a portion of the push button 28. Within the push button recess 54, a protrusion 56 may extend outward from a wall of push button recess 54 (e.g., from a front wall 58 of the spout 44 in the embodiment shown in FIG. 3A). The protrusion 56 may be sized and configured to retain the button bias member 34 positioned between the front wall 58 of the spout 44 and the push button 28.

Figure 4A:
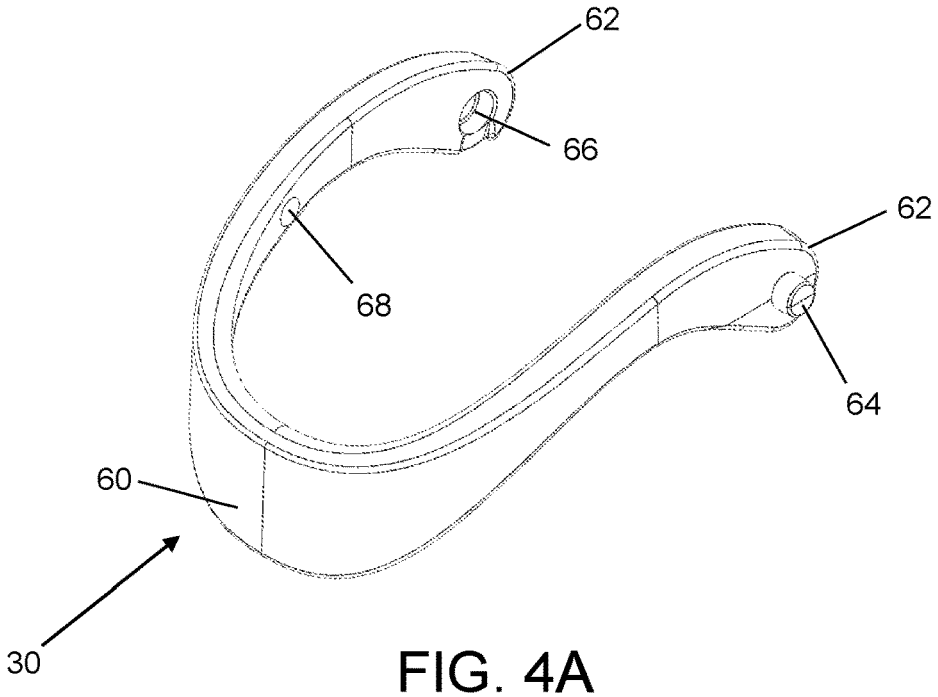
FIGS. 4A and 4B include an upper front perspective view and a lower front perspective view of a lock of the container lid of FIGS. 2A and 2B.
Figure 4B:
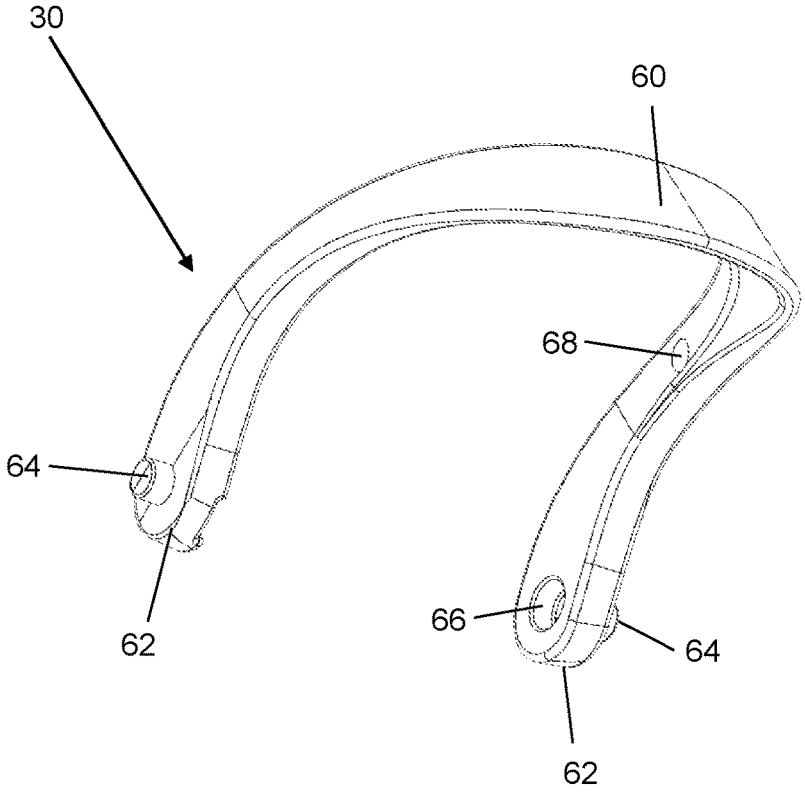

FIGS. 4A and 4B include an upper front perspective view (FIG. 4A) and a lower front perspective view (FIG. 4B) of the lock 30, in accordance with at least one embodiment described herein. The lock 30 may be implemented as a carry loop in some embodiments. The lock 30 may include a push button cover 60 between ends 62 of the lock 30. Each of the ends 62 may include a protrusion 64 and an opening 66. The openings 66 may be, for example, recesses, as shown in FIGS. 4A and 4B. In some other embodiments, the openings 66 may be holes. The push button cover 60 and ends 62 may form some or all of a handle or carry loop in some embodiments. Alternatively or additionally, the lock 30 may include one or more optional receiving portions 68 formed in the handle or carry loop between the push button cover 60 and each of the ends 62.

FIGS. 5A-5D include an upper front perspective view (FIG. 5A), a lower front perspective view (FIG. 5B), an upper rear perspective view (FIG. 5C), and a lower rear perspective view (FIG. 5D) of the closure 26, in accordance with at least one embodiment described herein. The closure 26 may include first protrusions 70, second protrusions 72, third protrusions 74, a closure engagement member 76, a seal protrusion 78, and/or a seal seat 80. In some embodiments, the closure 26 does not include all of the first protrusions 70, the second protrusions 72, and the third protrusions 74. For example, in some embodiments the closure 26 includes the first protrusions 70 but not the second protrusions 72 or the third protrusions 74. In some embodiments the closure 26 includes the second protrusions 72 but not the first protrusions 70 or the third protrusions 74. In some embodiments the closure 26 includes the third protrusions 74 but not the first protrusions 70 or the second protrusions 72. In some embodiments the closure 26 includes the first protrusions 70 and the second protrusions 72 but not the third protrusions 74. In some embodiments the closure 26 includes the first protrusions 70 and the third protrusions 74 but not the second protrusions 72. In some embodiments the closure 26 includes the second protrusions 72 and the third protrusions 74 but not the first protrusions 70. In some embodiments the closure includes none of the first protrusions 70, the second protrusions 72, or the third protrusions 74. Embodiments including the first protrusions 72, the second protrusions 74, or the third protrusions 74 may be shown and described with reference to two of each type of protrusion, however some embodiments may include only a single first protrusion 70, second protrusion 72, or third protrusion 74, or may include more than two first protrusions 70, second protrusions 72, or third protrusions 74.

Figure 6A:
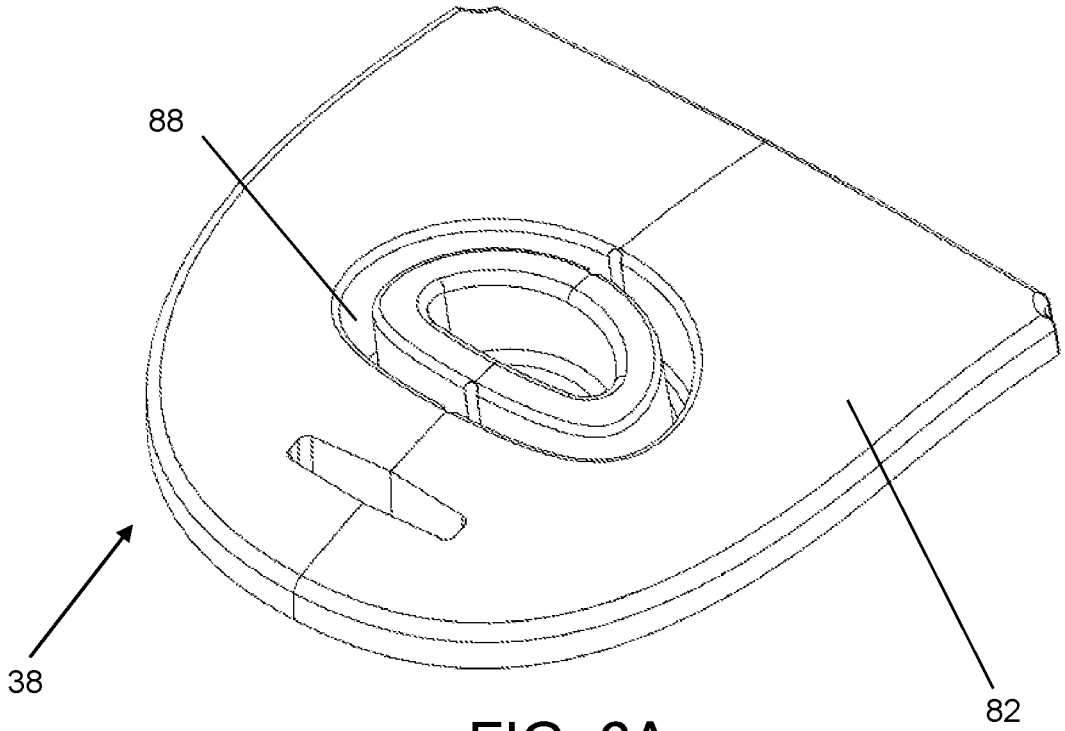
FIGS. 6A and 6B include an upper front perspective view and a lower front perspective view of a lid opening seal of the container lid of FIGS. 2A and 2B.
Figure 6B:
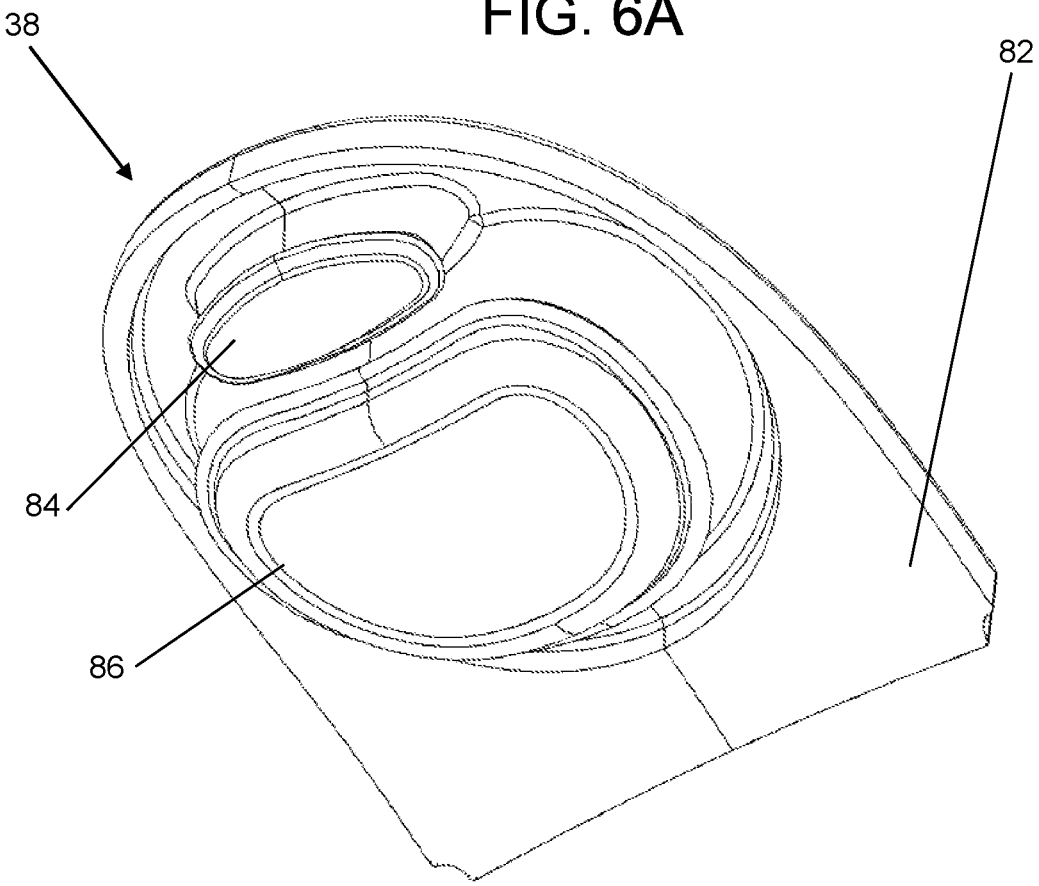
Figure 7A:
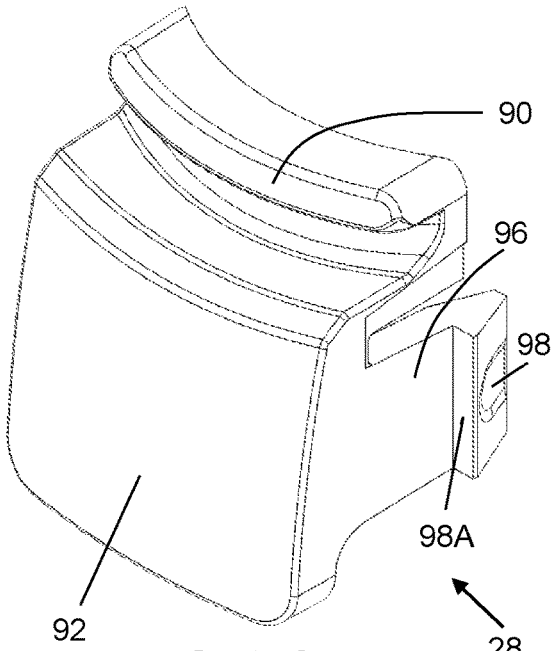
FIGS. 7A-7D include an upper front perspective view, a lower rear perspective view, a front view, and a rear view of a push button of the container lid of FIGS. 2A and 2B.
Figure 7B:
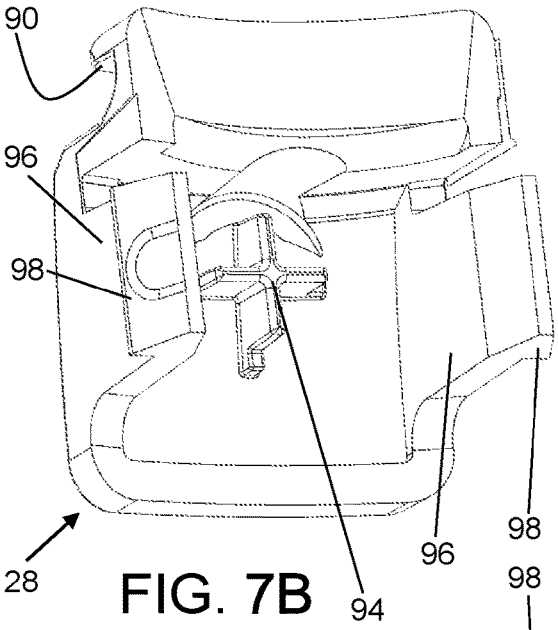
Figure 7C:
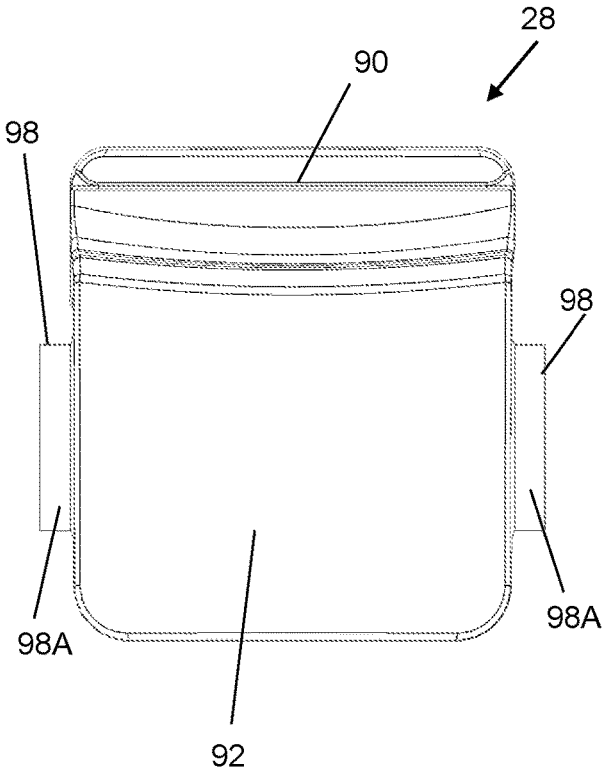
Figure 7D:
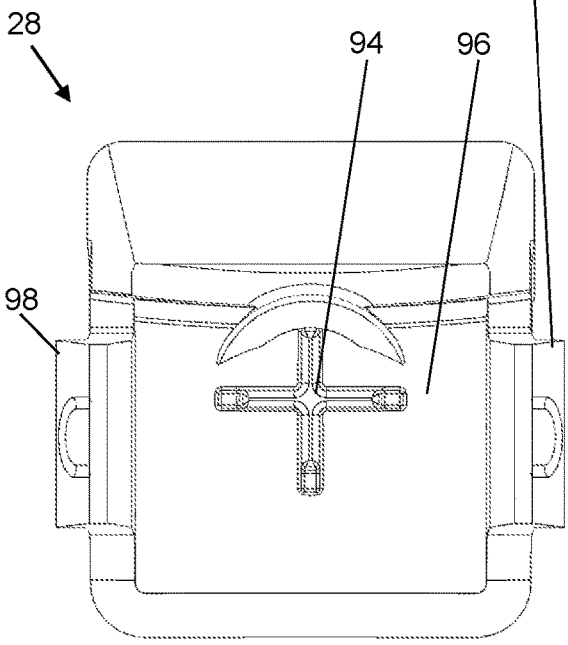

FIGS. 6A and 6B include an upper front perspective view (FIG. 6A) and a lower front perspective view (FIG. 6B) of the lid opening seal 38, in accordance with at least one embodiment described herein. The lid opening seal 38 may include a base 82, first and second seal portions 84 and 86 that extend downward from the base 82, and an opening 88 that passes through the base 82 at least partially into the second seal portion 86.

The base 82 of the lid opening seal 38 may be sized and configured to be received in the seal seat 80 of the closure 26. For example, the base 82 may have a complementary shape to the seal seat 80 of the closure 26 (see FIG. 5D).

Alternatively or additionally, the lid opening seal 38 may be formed of a resilient or at least partially resilient material and may be slightly oversized compared to the seal seat 80. As such, the lid opening seal 38 may be partially compressed to fit into the seal seat 80, the partial compression biasing the base 82 against the seal seat 80 and increasing friction (compared to no compression) between the base 82 and the seal seat 80 to retain the seal seat 80 coupled to the closure 26 via friction fit.

The first seal portion 84 of the lid opening seal 38 may be configured to seal the opening 50B in the spout 44. In an example embodiment, the first seal portion 84 may be sized and configured to be at least partially inserted into the opening 50B in the spout 44 to seal against an interior surface of the opening 50B below a top surface of the opening 50B. Alternatively or additionally, the first seal portion 84 may seal against the top surface of the opening 50B.

The second seal portion 86 of the lid opening seal 38 may be configured to seal the opening 50A in the spout 44. In an example embodiment, the second seal portion 84 may be sized and configured to be at least partially inserted into the opening 50A in the spout 44 to seal against an interior surface of the opening 50A below a top surface of the opening 50A. Alternatively or additionally, the second seal portion 86 may seal against the top surface of the opening 50A.

The lid opening seal 38 may independently seal each of the openings 50. Alternatively or additionally, the lid opening seal 38 may be configured to collectively seal the openings 50 together. For example, the lid opening seal 38 may seal against a top surface of an outer wall of the spout 44, e.g., with or without sealing against inner walls of the openings 50 (e.g., an inner wall of the spout 44 that separates the opening 50A from the opening 50B). Alternatively or additionally, the lid opening seal 38 may seal against an exterior surface of the outer wall of the spout 44.

Figure 5A:
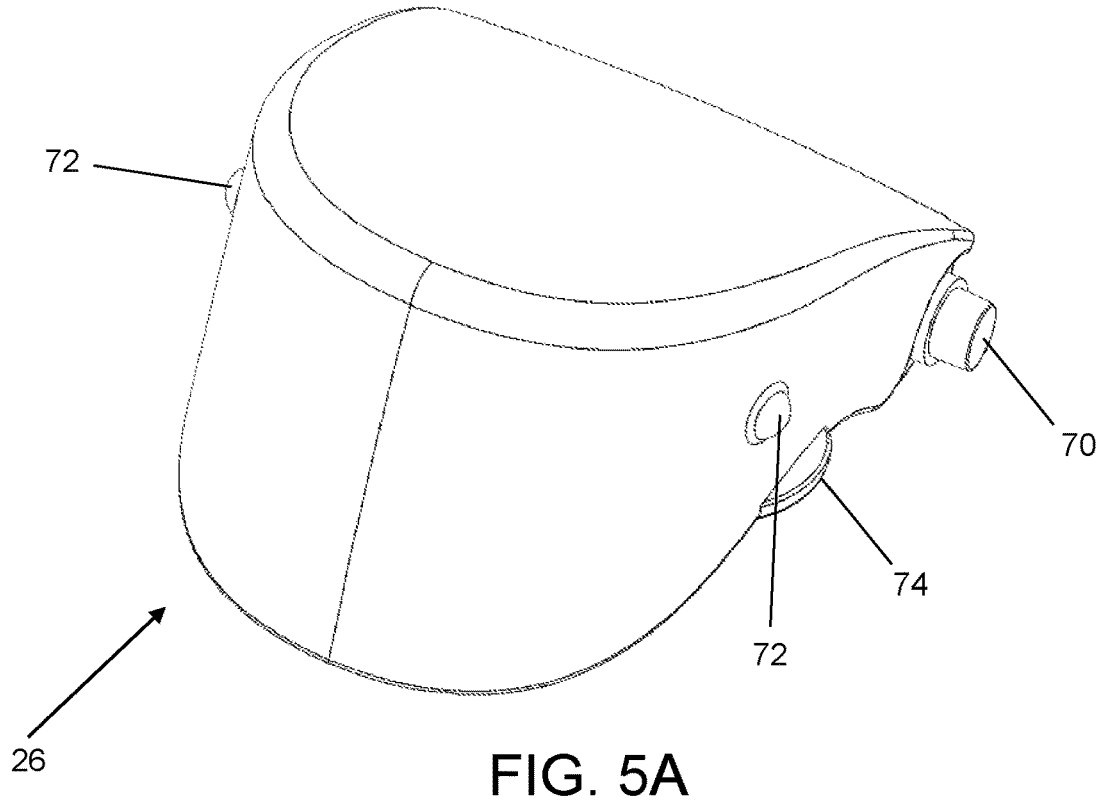
FIGS. 5A-5D include an upper front perspective view, a lower front perspective view, an upper rear perspective view, and a lower rear perspective view of a closure of the container lid of FIGS. 2A and 2B.
Figure 5B:
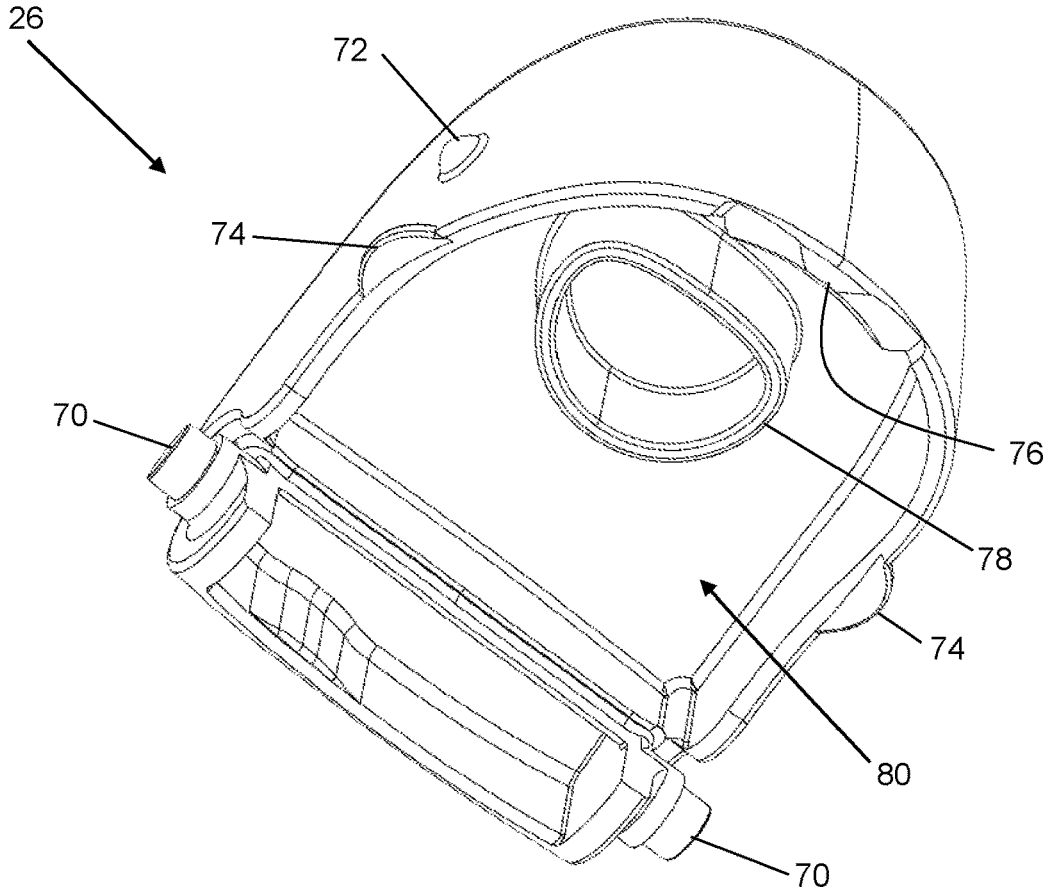
Figure 5C:
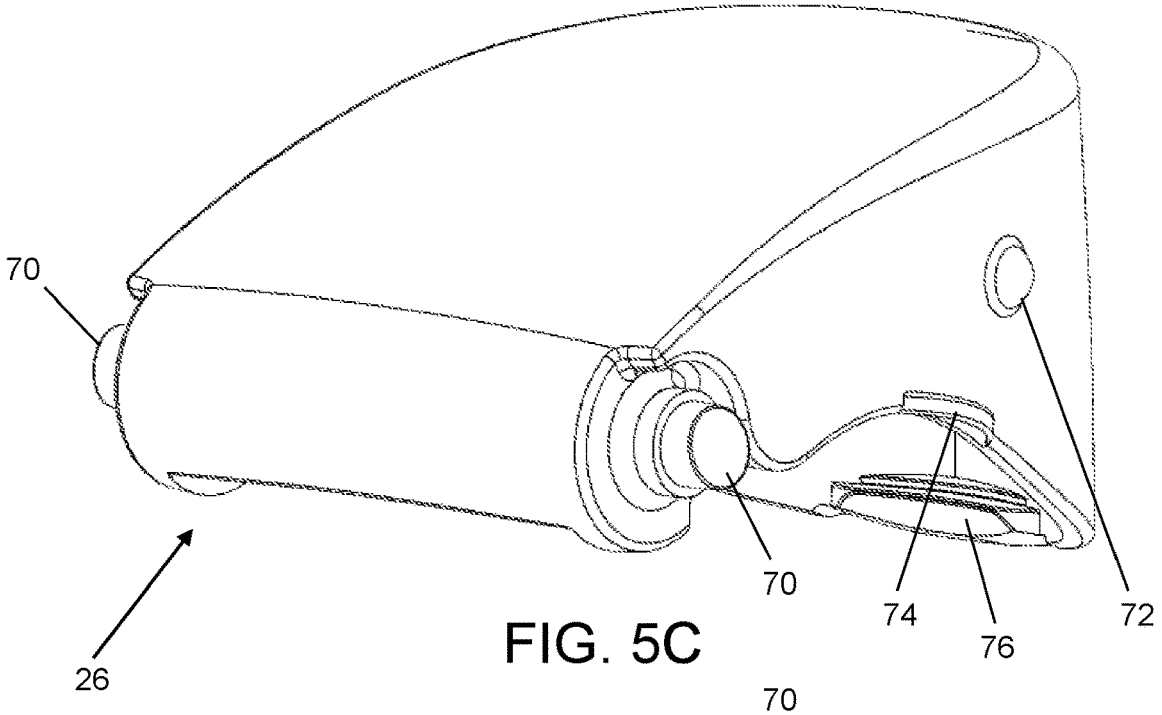
Figure 5D:
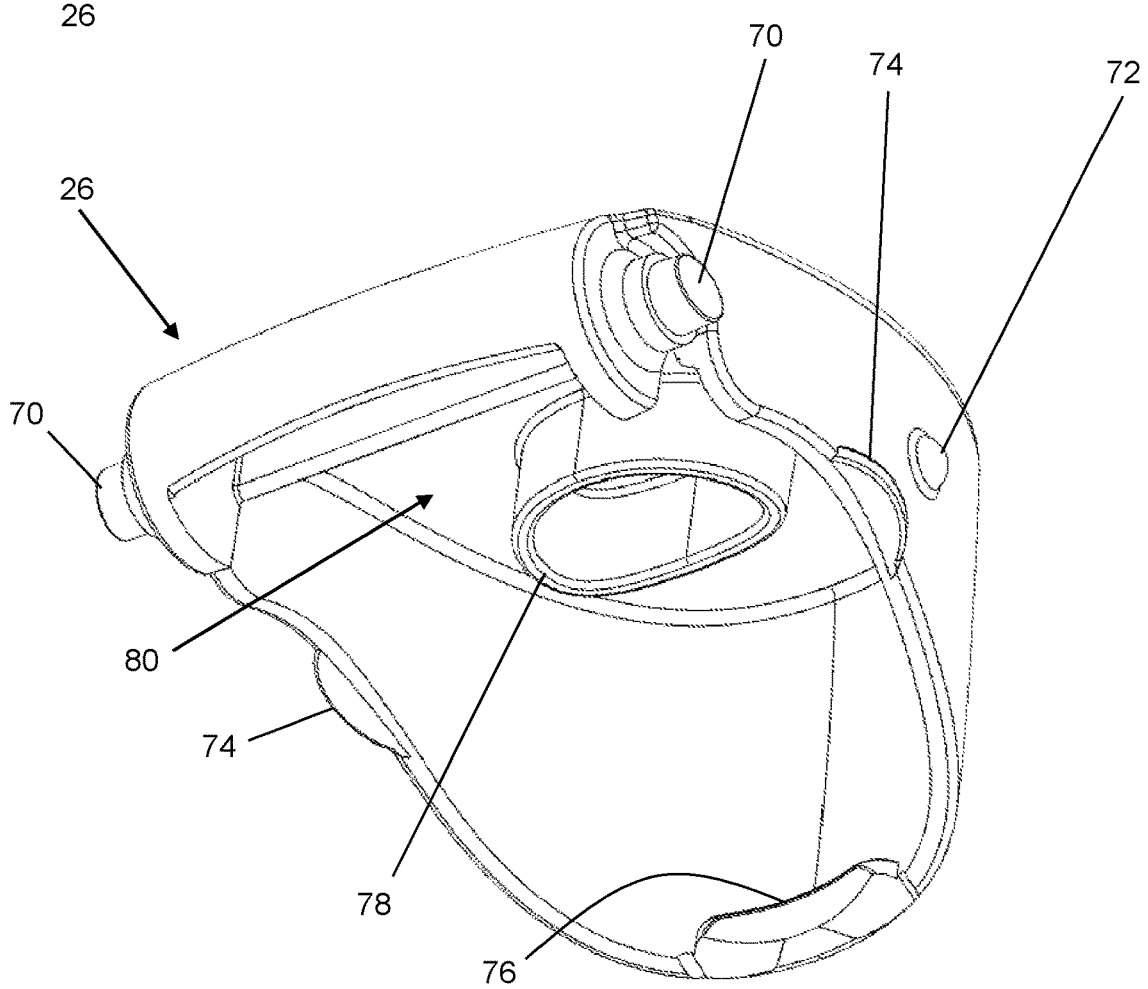

The opening 88 of the lid opening seal 38 may be sized and configured to receive therein the seal protrusion 78 of the closure 26 (see FIG. 5D). For example, the opening 88 may have a complementary shape to the seal protrusion 78. Positioning the seal protrusion 78 of the closure 26 inside the opening 88 may improve and/or increase a frictional coupling between the lid opening seal 38 and the closure 26 and/or may stiffen the second seal portion 86. For example, the closure 26, including the seal protrusion 78, may comprise a rigid or semi-rigid material or other material with greater rigidity than the lid opening seal 38. In the absence of the seal protrusion 78, the second seal portion 86 may tend to buckle, wrinkle, or otherwise deform when inserted into the opening 50A of the spout 44, which may decrease a likelihood of sealing the opening 50A. The presence of the seal protrusion 78 at least partially within the second seal portion 86 may stiffen the second seal portion 86 to reduce the likelihood of the second seal portion 86 buckling, wrinkling, or otherwise deforming in such a way as to interfere with sealing the opening 50A.

The lid opening seal 38 may be provided as a separate component from the closure 26. Alternatively or additionally, the lid opening seal 38 may be integrally formed with and/or may be coupled to the closure 26.

FIGS. 7A-7D include an upper front perspective view (FIG. 7A), a lower rear perspective view (FIG. 7B), a front view (FIG. 7C), and a rear view (FIG. 7D) of the push button 28, in accordance with at least one embodiment described herein. The push button 28 may include a push button engagement member 90, a contact portion 92, a protrusion 94, and/or one or more arms 96, each with at least one retention tab 98.

Referring to FIGS. 3A and 7A-7D, the retention tabs 98 may be configured to retain the push button 28 within the push button recess 54 of the container top 24. Each of the retention tabs 98 may generally extend outward from a corresponding one of the arms 96. Each of the arms 96 may be flexible or semi flexible to resiliently flex inward when the push button 28 is inserted into the push button recess 54 to assemble the push button 28 together with the container top 24. After a front-facing surface 98A of each of the retention tabs 98 clears a corresponding rear-facing surface of each of the cavities 55 of the push button recess 54, the arms 96 may each at least partially unflex outward such that the retention tabs 98 are received in the cavities 55. The push button 28 may still be movable relative to the container top 24 within a confined volume, the push button 28 being unable to move forward relative to the container top 24 beyond a point at which the front-facing surface 98A of each retention tab 98 engages the corresponding rear-facing surface of each cavity 55 of the push button recess 54.

Figure 8:
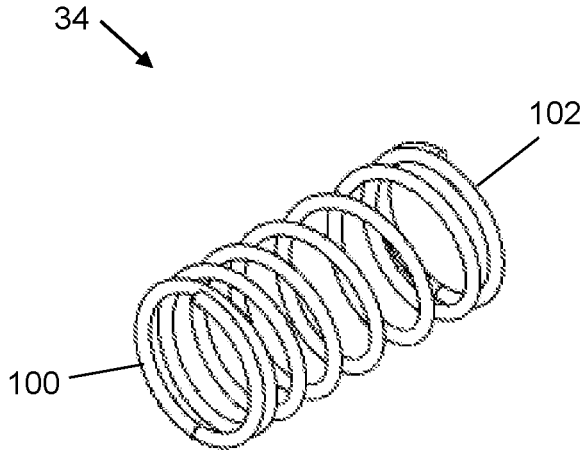
FIG. 8 is an upper front perspective view of a button bias member of the container lid of FIGS. 2A and 2B.

FIG. 8 is an upper front perspective view of the button bias member 34, in accordance with at least one embodiment described herein. The button bias member 34 may include a first end 100 and a second end 102. When the container lid 12 is assembled together, the button bias member 34 may be positioned between the push button 28 and the container top 24, with the protrusion 94 of the push button 28 received in the first end 100 of the button bias member 34 and the protrusion 56 of the container top 24 received in the second end 102 of the button bias member 34. In general, the button bias member 34 may be configured to bias the push button 28 forward relative to the container top 24, e.g., to a point at which the front-facing surface 98A of each retention tab 98 of the push button 28 engages the corresponding rear-facing surface of each cavity 55 of the push button recess 54 of the container top 24. Although FIG. 8 illustrates an example button bias member 34 comprising a coil spring, the button bias member 34 can have other forms and be made of one or more of a variety of materials. For example, the button bias member 34 can comprise one or more of a metal, a polymer, or other materials, and can comprise shapes other than a coil.

Figure 9:
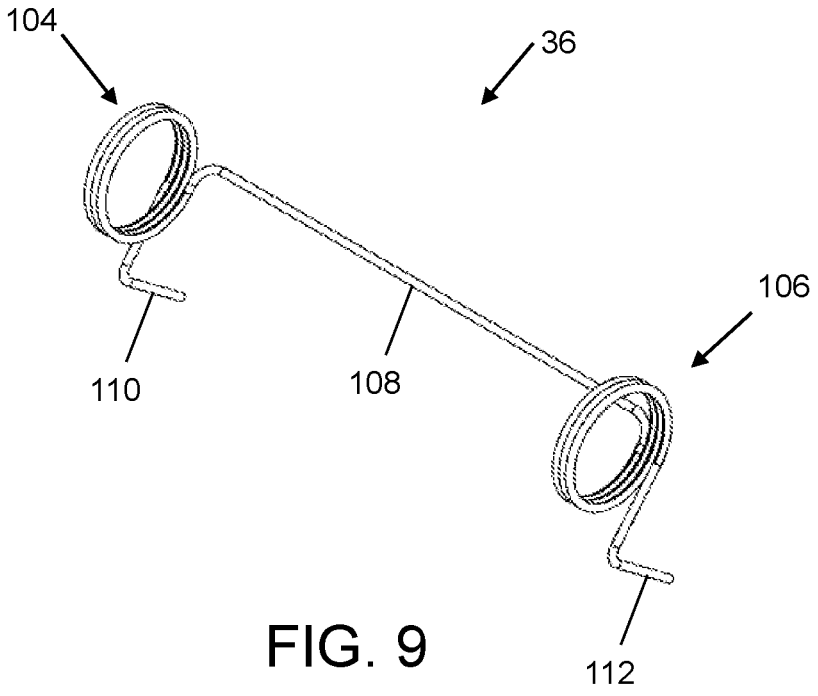
FIG. 9 is an upper front perspective view of a closure bias member of the container lid of FIGS. 2A and 2B.

FIG. 9 is an upper front perspective view of the closure bias member 36, in accordance with at least one embodiment described herein. The closure bias member 36 may include a first end 104, a second end 106, and a cross bar 108. The first end 104 of the closure bias member 36 may include a first foot 110 and the second end 106 of the closure bias member 36 may include a second foot 112. Although FIG. 9 illustrates an example closure bias member 36, the closure bias member 36 can have other forms and be made of one or more of a variety of materials. For example, the closure bias member 36 can comprise one or more of a metal, a polymer, or other materials, and can comprise shapes other than that illustrated and described herein.

Referring to FIGS. 1A-4B, the lock 30 may be movably coupled to the container top 24, the closure 26, or both for movement between a locked position and an unlocked position. For example, the lock 30 may be rotatably coupled to the container top 24, the closure 26, or both. The lock 30 may be rotatably coupled to the container top 24 through, for example, the pivot mounts 46, which may define a rotational axis of the lock 30. In the illustrated embodiment, each of the pivot mounts 46 defines a corresponding one of the openings 52 which is configured to receive a corresponding one of the protrusions 64 of the lock 30. The protrusions 64 of the lock 30 are received and retained in the openings 52 of the pivot mounts 46 during operation and permit the lock 30 to rotate relative to the container top 24.

Referring to FIGS. 1A-5D, the closure 26 may be movably coupled directly or indirectly to the container top 24. For example, the closure 26 may be rotatably coupled to the container top 24. The closure 26 may be rotatably coupled to the container top 24 through, for example, the lock 30 and the pivot mounts 46 of the container top 24. In the illustrated embodiment, each of the ends 62 of the lock 30 defines a corresponding one of the openings 66 which is configured to receive a corresponding one of the protrusions 70 of the closure 26. The protrusions 70 of the closure 26 are received and retained in the openings 66 of the lock 30 during operation and permit the closure 26 to rotate relative to the lock 30, and also relative to the container top 24 when the lock 30 is rotatably coupled to the container top 24. In some embodiments, the closure 26 may rotate relative to the container top 24 about the same axis of rotation as the lock 30 (e.g., the closure 26 and the lock 30 may rotate relative to container top 24 and relative to each other about the same axis). In other embodiments, the closure 26 may rotate relative to the container top 24 about a different axis of rotation than the lock 30.

The closure 26, alone or in combination with the lid opening seal 38, may be configured to selectively cover, close, and/or seal the spout 44 and/or one or more (e.g., all) of the lid openings 50. The closure 26 may be movable and optionally rotatable relative to the container top 24 between a first position and a second position. In the first position, the spout 44 and/or one or more (e.g., all) of the lid openings 50 may be covered, closed, and/or sealed by the closure 26 alone or in combination with the lid opening seal 38. In the second position, the spout 44 and/or one or more (e.g., all) of the lid openings 50 may be exposed, uncovered, open, and/or unsealed by the closure 26.

Referring to FIGS. 1A-5D and 7A-7D, the push button 28 may be movably coupled to one or more of the container top 24 and the closure 26 and may be configured to selectively retain the closure 26 in the first position. As described above, for example, the arms 96 and/or retention tabs 98 of the push button 28 may cooperate with the cavities 55 of the push button recess 54 of the container top 24 to retain the push button 28 at least partially within the push button recess 54, while permitting at least some movement of the push button 28 relative to the container top 24. In other embodiments, an analogous arrangement may be implemented to movably couple the push button 28 to the closure 26.

In some push-button mechanisms, a push button may be free-floating, rotatable, or slidable (e.g., on or within a track) relative to another component. In at least one embodiment, the push button 28 may have a hybrid arrangement relative to the container top 24 that involves a combination of two or more of the foregoing. For example, the push button 28 may be both free-floating and rotatable relative to the container top 24 in an embodiment. More generally, the push button 28 may be free-floating within the push button recess 54 relative to the container top 24, slidable within the push button recess 54 relative to the container top 24, rotatable within the push button recess 54 relative to the container top 24, or some combination thereof The push button 28 may be movable with respect to the container top 24 and the closure 26 between a latched position (i.e., an unpushed position) and an unlatched position (i.e., a pushed position). The push button 28 may be configured to selectively retain the closure 26 in the first position of the closure 26 in which the spout 44 and/or one or more of the lid openings 50 is closed, covered, and/or sealed. For example, when the push button 28 is in the latched position and the closure 26 is in the first position, the push button 28 may retain the closure 26 in the first position. In these and other embodiments, at least a portion of the push button 28 may engage at least a portion of the closure 26 when the closure 26 is in the first position to retain the closure 26 in the first position. Alternatively or additionally, in at least one embodiment in which the push button 28 is movably coupled to the closure 26, at least a portion of the push button 28 may selectively engage at least a portion of the container top 24 when the closure 26 is in the first position to selectively retain the closure 26 in the first position.

In the unlatched position, the push button 28 may be disengaged from the closure 26 when the closure 26 is in the first position, or when the closure 26 is in any other position. Accordingly, when the push button 28 is in the unlatched position, the closure 26 may be free to remain in the first position or move to the second position without interference from the push button 28.

The closure bias member 36 may be configured to bias the closure 26 to the second position. For example, when the push button 28 is in the unlatched position, the closure bias member 36 may cause the closure 26 to automatically move from the first position to the second position. In this regard, the first and second feet 110, 112 of the closure bias member 36 may engage the end wall 40 or other portion of the container top 24 and the cross bar 108 of the closure bias member 36 may engage the closure 26 such that when the closure 26 is in the first position, the closure bias member 36 is loaded and when the closure 26 is in the second position, the closure bias member 36 is unloaded—or at least less loaded than in the first position.

The lock 30 may be configured to selectively inhibit operation of the push button 28. When the lock 30 is in the locked position, operation of the push button 28 may be inhibited. For example, when the lock 30 is in the locked position, the lock 30 may be configured to inhibit movement of the push button 28 from the latched position to the unlatched position. When the lock 30 is in the unlocked position, operation of the push button 28 may be uninhibited. For example, when the lock 30 is in the unlocked position, the lock 30 may not interfere with or otherwise inhibit movement of the push button 28 from the latched position to the unlatched position.

Figure 10C:
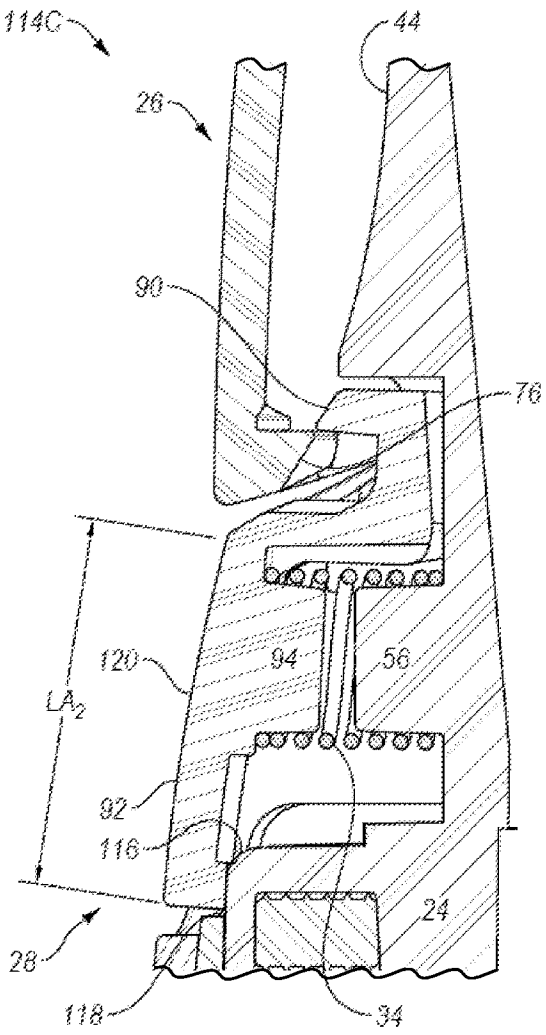
FIGS. 10A-10C include cross-sectional side views of a portion of the container lid of FIG. 2A.
Figure 10B:
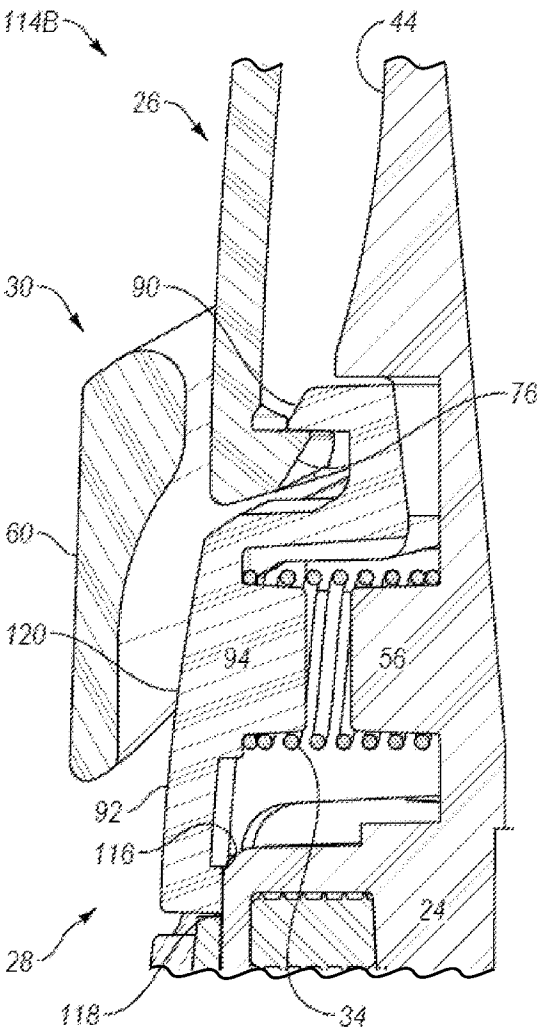
Figure 10A:
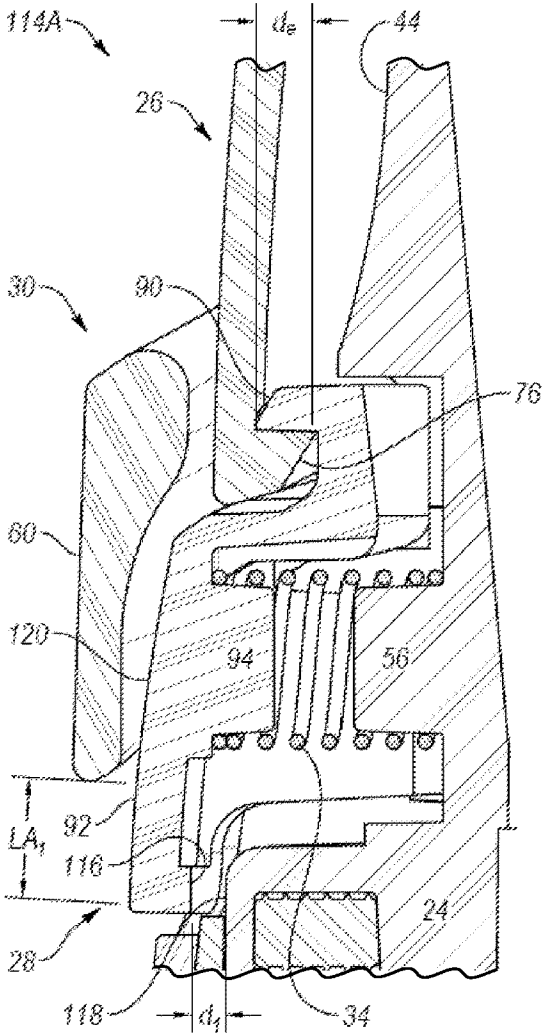

FIGS. 10A-10C include cross-sectional side views of a portion of the container lid 12 of FIG. 2A, in accordance with at least one embodiment described herein. FIG. 10A includes view 114A, FIG. 10B includes view 114B, and FIG. 10C includes view 114 C. The lock 30 is illustrated in the views 114A and 114B in the locked position, but is not shown in the view 114C and may be in an unlocked position.

It can be seen from a comparison of the views 114A and 114B to the view 114C that the contact portion 92 of the push button 28 may be accessible when the lock 30 is in the unlocked position. In comparison, the contact portion 92 of the push button 28 may be at least partially obscured, blocked, or covered by the lock 30, and in particular by the push button cover 60 of the lock 30, or may be otherwise at least partially inaccessible when the lock 30 is in the locked position. When the lock 30 is in the unlocked position, an opening force may be applied to the contact portion 92, for example by a user's finger or thumb, to move the push button 28 from the latched position to the unlatched position.

The push button 28 is illustrated in the view 114A in the latched position and in the view 114C in the unlatched position. As illustrated, the push button engagement member 90 of the push button 28 may selectively engage the closure engagement member 76 of the closure 26 to selectively retain the closure 26 in the first position. In particular, in the latched position, and as illustrated in the view 114A, the push button engagement member 90 engages the closure engagement member 76 to retain the closure 26 in the first position. In the unlatched position, and as illustrated in the view 114C, the push button engagement member 90 is disengaged from the closure engagement member 76 such that the push button 28 does not retain the closure 26 in the first position.

As illustrated in the view 114A, a portion of the push button 28 (e.g., a bottom rear 116 of the contact portion 92) may be horizontally spaced apart from a button stop 118 of the container top 24 by a first distance $d_1$ when the push button 28 is in the latched position and the closure 26 is in the first position. In addition, the push button engagement member 90 may horizontally overlap the closure engagement member 76 by an engagement distance $d_e$ when the push button 28 is in the latched position and the closure 26 is in the first position. As shown in view 114A, the engagement distance $d_e$ can be greater than the first distance $d_1$. Accordingly, and as illustrated in the view 114B, if the push button 28 is moved exclusively horizontally toward the container top 24 through the first distance $d_1$, e.g., until the push button 28 (e.g., at the bottom rear 116 of the contact portion 92) contacts the button stop 118 of the container top 24, the push button engagement member 90 remains engaged with the closure engagement member 76 such that the closure 26 may remain in the first position.

Notwithstanding the first distance $d_1$ being less than the engagement distance $d_e$, the push button engagement member 90 may move through the engagement distance $d_e$ through any combination of translation (e.g., horizontal movement) and rotation of the push button 28. For example, the views 114A and 114C together show that the push button 28 translates horizontally (e.g., to the right from view 114A in FIG. 10A to view 114B in FIG. 10B) and rotates (e.g., clockwise from view 114B in FIG. 10B to view 114C in FIG. 10C) relative to the container top 24 to permit horizontal movement of the push button engagement member 90 through the engagement distance $d_e$ relative to the closure engagement member 76, thereby moving the push button 28 from the latched position in the view 114A to the unlatched position in the view 114C.

In the view 114C, the push button 28 is rotated about 4 degrees compared to the views 114A and 114B. The amount of rotation to reach the unlatched position from the latched position may depend on the amount of horizontal translation permitted between the push button 28 and the container top 24. For a given engagement distance $d_e$, the greater the horizontal translation of the push button 28 (e.g., the greater the first distance $d_1$ in the example of FIG. 10A), the less the rotation of the push button 28 to reach the unlatched position. In general, the push button 28 may be configured to rotate relative to the container top 24 within a range between about 0 to 10 degrees (e.g., between about 2 to 10 degrees), or between about 0 to 7 degrees (e.g., between about 2 to 7 degrees), or between about 0 to 5 degrees (e.g., between about 2 to 5 degrees). In some embodiments, no rotation of the push button 28 is required for the push button engagement member 90 to travel the engagement distance $d_e$ relative to the closure engagement member 76 and thereby move the push button 28 to an unlatched position. In some embodiments, no translation of the push button 28 is required for the push button engagement member 90 to travel the engagement distance $d_e$ relative to the closure engagement member 76 and thereby move the push button 28 to an unlatched position.

Further, within a given implementation, the push button 28 need not translate through the entire first distance $d_1$ to reach the unlatched position, provided the push button 28 can rotate more to compensate. For example, in the view 114C compared to the view 114A, the bottom rear 116 of the contact portion 92 of the push button 28 translates the entire first distance $d_1$ and the push button 28 rotates 4 degrees to reach the unlatched position. However, the unlatched position may also be reached by the bottom rear 116 translating only a fraction of the first distance $d_1$, such as only 90% of the first distance $d_1$, and the push button 28 rotating more than 4 degrees (e.g., 5 or 6 degrees). Thus, the unlatched position of the push button 28 does not necessarily refer to a single position and orientation of the push button 28 relative to the container top 24 (e.g., the position and orientation illustrated in the view 114C), but rather it refers to any position and orientation of the push button 28 relative to the container top 24 in which the push button 28 is disengaged from the closure 26. An analogous interpretation may be applied to the other positions described herein.

As illustrated in the views 114A and 114B, the lock 30 in the locked position, particularly the push button cover 60 of the lock 30, obscures, blocks, covers, or otherwise renders generally inaccessible at least a portion 120 of the push button 28. The push button cover 60 of the lock 30 may include holes or openings (e.g., ornamental holes or openings) and/or may be made of an optically transparent material such that the portion 120 of the push button 28 may be at least partially visible when the lock 30 is in the locked position while still being obscured, blocked, covered, and/or generally inaccessible to a user.

The portion 120 of the push button 28 that is obscured, blocked, covered, and/or generally inaccessible may include at least half of the push button 28, such as at least an upper half of the push button 28 or a half of the push button 28 opposite an axis of rotational movement of the push button 28 for example. Alternatively or additionally, the portion 120 may include at least half of the contact portion 92, such as at least an upper half of the contact portion 92 or a half of the contact portion 92 opposite an axis of rotational movement of the push button 28 for example. Alternatively or additionally, the portion 120 may include a centroid of the push button 28 or the contact portion 92; a center or central axis of the push button 28, the contact portion 92, the button bias member 34, and/or of the protrusion 94 of the push button 28; a projection, along the button's path of travel, of the protrusion 94 or the button bias member 34 onto the contact portion 92; a projection, along the button's path of travel, of the centroid of the button bias member 34 and/or of the protrusion 94 of the push button 28 onto contact portion 92; or some other portion of the push button 28.

With the lock 30 in the locked position, it may require application of a significant and/or significantly greater amount of force to the portion of the contact portion 92 that is accessible (not obscured, blocked, covered, and/or rendered generally inaccessible by the push button cover 60 of the lock 30) to move the push button 28 from the latched position to the unlatched position (as compared to the amount of force used to move the push button 28 from the latched position to the unlatched position with the lock 30 in the open position). For example, the button stop 118 may act as a fulcrum and the contact portion 92 that is accessible, e.g., to a user's thumb or finger when the lock 30 is in the locked position, provides a relatively short maximum lever arm $LA_1$ (view 114A). With the resistance provided by the button bias member 34, it may therefore require application of a significant and/or significantly greater amount of force to the contact portion 92 that is accessible when the lock 30 is in the locked position considering the relatively short maximum lever arm $LA_1$ (e.g., at a topmost extent of the accessible portion of the contact portion 92, as illustrated in the view 114A).

In comparison, and referring to view 114C in FIG. 10C, when the lock 30 is in the unlocked position, the extent (e.g., topmost extent) of the contact portion 92 that is accessible and which is within the portion 120 provides a much longer lever arm $LA_2$ (see view 114C in FIG. 10C). Thus, the amount of force applied to the topmost extent of the contact portion 92 that is accessible when the lock 30 is in an unlocked position to move the push button 28 from the latched position to the unlatched position may be much less than the amount of force applied to the topmost extent of the contact portion 92 that is accessible when the lock 30 is in the locked position to move the push button 28 from the latched position to the unlatched position. Accordingly, the lock 30 in the locked position may inhibit movement of the push button 28 from the latched position to the unlatched position or may otherwise inhibit operation of the push button 28, e.g., by inhibiting a finger or thumb or other body part of a user from applying an opening force to the portion 120 of the push button 28 or otherwise inhibiting access by a user to the portion 120 of the push button 28. Alternatively or additionally, the lock 30 and/or one or more intervening components may engage with the push button 28 when the lock 30 is in the locked position to inhibit movement of the push button 28 from the latched position to the unlatched position.

Figure 11A:
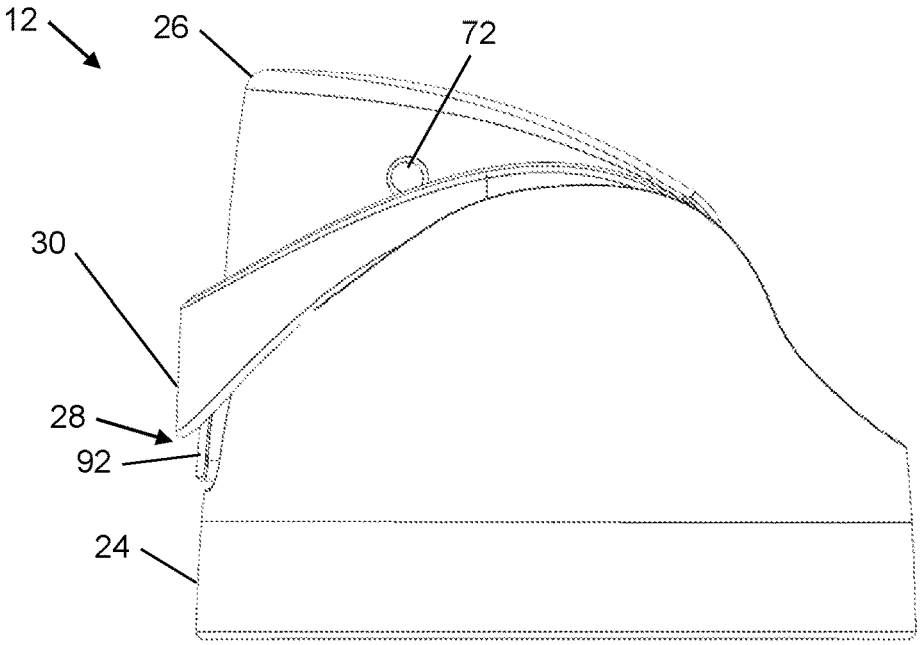
FIGS. 11A-11C include side views of the container lid with the lock in, respectively, the locked position, a first unlocked position, and a second unlocked position.
Figure 11B:
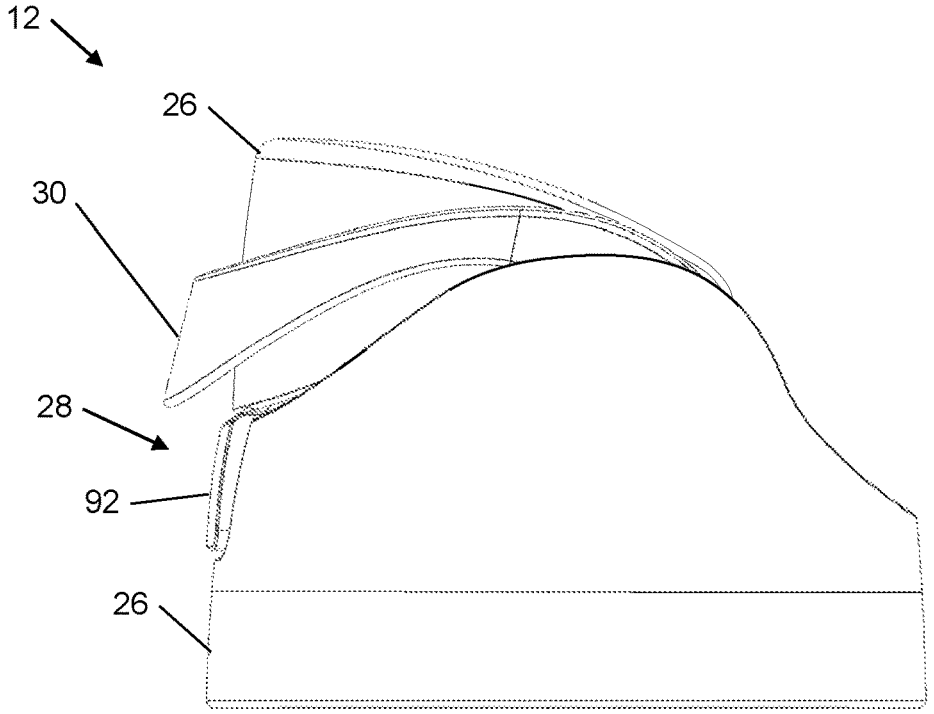
Figure 11C:
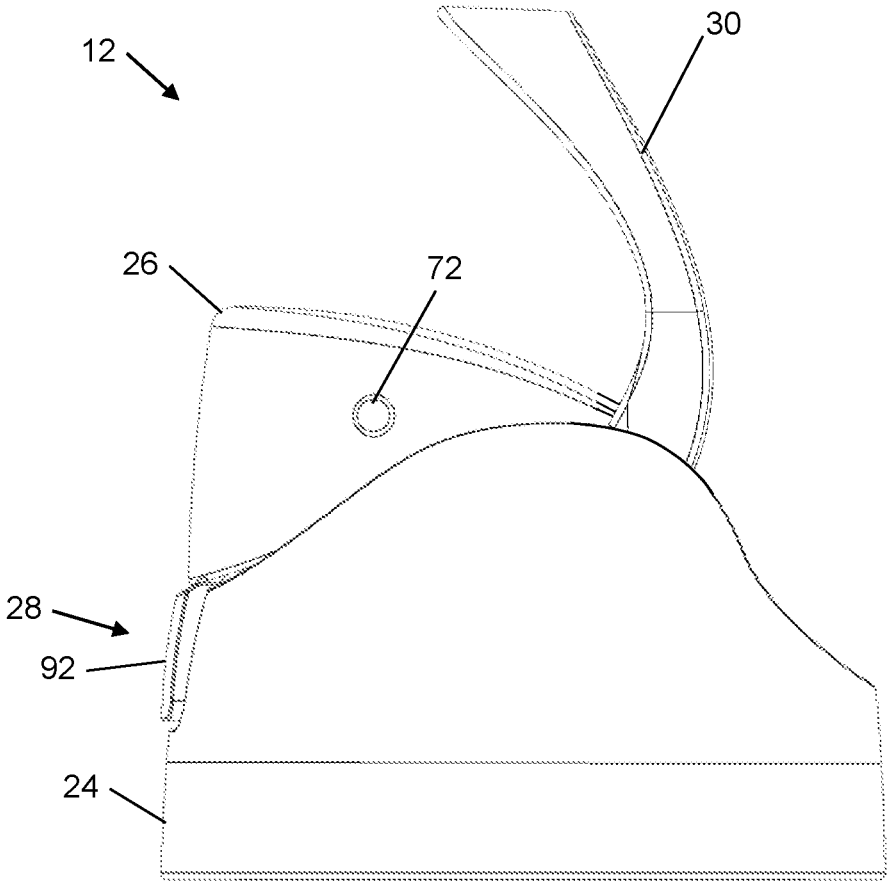
Figure 12:
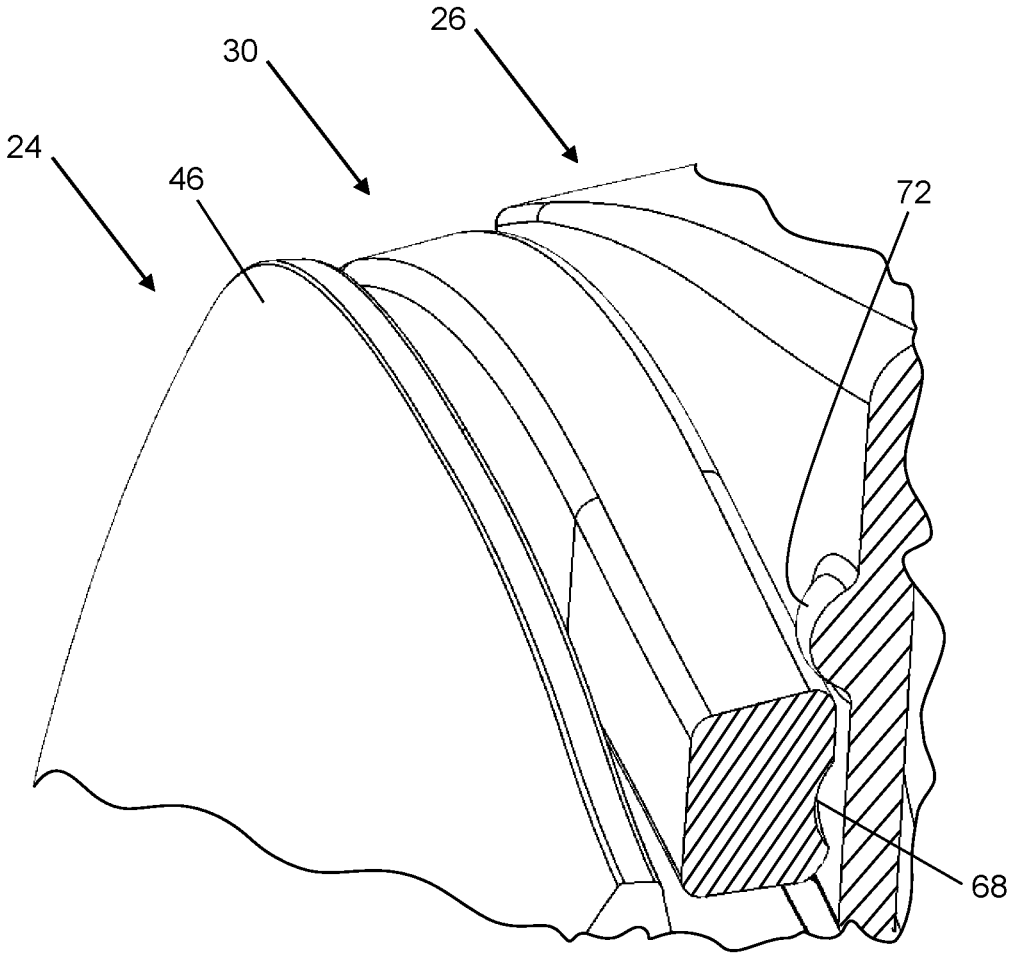
FIG. 12 includes a cross-sectional front perspective view of a portion of the container lid with the lock in a locked position.

FIGS. 11A-11C include side views of the container lid 12 with the lock 30 in, respectively, the locked position (FIG. 11A), a first unlocked position (FIG. 11B), and a second unlocked position (FIG. 11C), in accordance with at least one embodiment described herein. FIG. 12 includes a cross-sectional front perspective view of a portion of the container lid 12 with the lock 30 in the locked position, in accordance with at least one embodiment described herein. The unlocked positions of FIGS. 11B and 11C are referenced in this description as a "first" unlocked position (FIG. 11B) and a "second" unlocked position (FIG. 11C) for convenience only. Some embodiments include only locked and unlocked positions, without distinction between multiple unlocked positions. Further, some embodiments include the second unlocked position as shown in FIG. 11C and described in more detail below, but do not include a distinct first unlocked position as shown in FIG. 11B and described in more detail below.

Referring to FIGS. 4A-5D, 11A, and 12, when the lock 30 is in the locked position, the second protrusions 72 of the closure 26 may be positioned above at least a portion of the lock 30 and may be above the receiving portions 68 of the lock 30, if present. The second protrusions 72 may interfere with the lock 30 to inhibit movement of the lock 30 out of the locked position. For example, the lock 30 may have to flex or deform to move out of the locked position past the protrusions 72.

Referring to FIGS. 4A-5D and 11B, when the lock 30 is in the first unlocked position, the second protrusions 72 of the closure 26 may be positioned within and engage the receiving portions 68 of the lock 30. As mentioned above, some embodiments do not include the first unlocked position, and as such, in those embodiments lock 30 may not include receiving portions 68. In this and other embodiments, as the lock 30 is moved from the locked position to the unlocked position, the lock 30 may flex outward or otherwise resiliently deform as the lock 30 passes over the second protrusions 72 of the closure 26. When the second protrusions 72 reach the receiving portions 68, the lock 30 may at least partially unflex or otherwise return to an at least partially undeformed state, such that the second protrusions 72 are positioned at least partially within and optionally matingly engage with the receiving portions 68, effectively coupling the lock 30 and the closure 26 together. In some embodiments, with the lock 30 in the first unlocked position and the lock 30 and the closure 26 coupled together, the lock 30 and the closure 26 may be dependently rotatable relative to the container top 24. That is, when the lock 30 is in the first unlocked position and the lock 30 and the closure 26 are coupled together through the second protrusions 72 and the receiving portions 68, rotation of the lock 30 or the closure 26 may cause rotation of the other of the closure 26 and the lock 30.

In some embodiments including second protrusions 72 and receiving portions 68, the second protrusions and the receiving portions may be positioned such that the second protrusions 72 are received in the receiving portions 68 when the lock 30 is in the locked position rather than in an unlocked position. In some embodiments, the closure 26 may comprise multiple sets of second protrusions 72, each set comprising one or more second protrusions 72, with each set positioned to be received in the receiving portions 68 of the lock 30 in a different position of the closure 26 relative to the lock 30. For example, a first set of second protrusions 72 may be received in the receiving portions 68 when the lock 30 is in the locked position and a second set of second protrusions 72 may be received in the receiving portions 68 when the lock 30 is in an unlocked position. Additionally or alternatively, the lock may be positioned between sets of second protrusions.

The locations of the second protrusions 72 on the closure 26 and the receiving portions 68 on the lock 30 may be reversed (e.g., second protrusions 72 on the lock 30 and receiving portions 68 on the closure 26) and/or other coupling structures may be provided to selectively couple the lock 30 and the closure 26 together. For example, the multiple sets of second protrusions 72 comprised by the closure 26 may be replaced by sets of receiving portions 68. Some embodiments do not include the first unlocked position. For example, in some embodiments the lock 30 does not include receiving portions 68.

Referring to FIGS. 4A-5D and 11C, in some embodiments, when the lock 30 is in the second unlocked position, the lock 30 may be suitable for use as a handle or carry loop. In the second unlocked position, at least some of the lock 30, including the receiving portions 68 (if included), may be positioned above the second protrusions 72 (if included) such that the second protrusions 72 are not within the receiving portions 68 and the lock 30 is not engaged with the closure 26. In some embodiments, when the lock 30 is in the second unlocked position, the lock 30 and the closure 26 may be independently rotatable relative to the container top 24.

In the second unlocked position illustrated in FIG. 11C, the lock 30 is rotated about 90 degrees clockwise compared to the locked position of FIG. 11A. More generally, the second unlocked position may be any position in which the lock 30 has cleared, e.g., rotated past, the second protrusions 72 (if included).

In some embodiments, each of the second protrusions 72 and the third protrusions 74 may be capable of engaging the lock 30 and moving the lock 30 backward (e.g., clockwise in FIGS. 11A-11C) along with movement of the closure 26. And the second protrusions 72 may also be capable of engaging the lock 30 and moving the lock forward (e.g., counterclockwise in FIGS. 11A-11C) along with movement of the closure 26. For example, with the closure 26 out of the first position, e.g., in the second position, the lock 30 may be positioned relative to the closure 26 with the lock 30 between the second protrusions 72 and the third protrusions 74 of the closure 26, if present (see, e.g., FIGS. 5A and 5B). In this relative configuration, the third protrusions 74 may engage the lock 30 if and when the closure 26 is rotated backward (e.g., clockwise in FIGS. 11A-11C) so that the lock 30 rotates backward with the closure 26, and the second protrusions 72 may engage the lock 30 if and when the closure 26 is rotated forward (e.g., counterclockwise in FIGS. 11A-11C).

Also for example, with the closure 26 out of the first position, e.g., in the second position, the lock 30 may be positioned relative to the closure 26 such that the protrusions 72 are at least partially within the receiving portions 68 (if present) of the lock 30. In this relative configuration (which may correspond to the first unlocked position of the lock 30), the second protrusions 72 may engage the lock 30 (e.g., via the receiving portions 68) if and when the closure 26 is rotated backward or forward (e.g., clockwise or counterclockwise in FIGS. 11A-11C).

Also for example, with the closure 26 out of the first position, e.g., in the second position, the lock 30 may be positioned relative to the closure 26 with the lock 30 past the second protrusions 72 (e.g., past the second protrusions 72 in the clockwise direction in FIGS. 11A-11C, on the opposite side of the second protrusions 72 from the third protrusions 74, if present). In this relative configuration (which may correspond to the second unlocked position of the lock 30), the second protrusions 72 may engage the lock 30 if and when the closure 26 is rotated backward (e.g., clockwise in FIGS. 11A-11C) far enough for the second protrusions 72 to contact the lock 30 so that the lock 30 rotates backward with the closure 26. But forward rotation of the closure 26 (e.g., counterclockwise in FIGS. 11A-11C) may not engage the lock 30, such that when the closure 26 is rotated forward it may not cause the lock 30 to rotate forward.

In some embodiments, in use a user may move the lock 30 from the locked position to an unlocked position (e.g., the second unlocked position) in which the lock 30 may freely rotate independent of the container top 24 and of the closure 26. With the lock in such an unlocked position, the user may push the push button 28 to disengage the closure 26 so that the closure 26 is free to move from the first (closed) position to the second (open) position. Afterward, the user may optionally rotate the closure 26 and the lock 30 relative to each other to such an extent that the second protrusions 72 rotate past the lock 30 so that the lock 30 is disposed between the second protrusions 72 and the third protrusions 74, thereby engaging the lock 30 with the closure 26 and coupling the motion of the closure 26 and the lock 30 together (the lock 30 and closure 26 may be similarly disengaged). In this way, when the user closes the closure 26 by moving it to the first position, the lock 30 engaged with the closure 26 travels along with the closure 26 and into the locked position. When the lock 30 is engaged with the closure 26, both the lock and the closure may rotate together about their shared axis. When the lock 30 is disengaged from the closure 26 (e.g., not in contact with second protrusions 72 or third protrusions 74, if present), the lock 30 and the closure 26 may rotate independently about the axis.

The embodiment described herein may be modified in a variety of ways without altering the scope of the claimed embodiments. In general, for example, some features or components disclosed as engaging with each other or operating together may be reversed, modified, or substituted for a functional equivalent. As already described above, for example, the locations of the second protrusions 72 on the closure 26 and the receiving portions 68 on the lock 30 may be reversed such that the second protrusions are on the lock 30 and the receiving portions 68 are on the closure 26. Similarly, the locations of the protrusions 64 on the lock 30 and the openings 52 on the container top 24 may be reversed such that the protrusions 64 are on the container top 24 and the openings 52 are on the lock 30. Similarly, the locations of the openings 66 on the lock 30 and the first protrusions 70 on the closure 26 may be reversed such that the openings 66 are on the closure 26 and the first protrusions 70 are on the lock. Alternatively, the first protrusions 70 of the closure 26 may extend all the way through thru-hole openings in the lock 30 to the openings 52 of the container top 24, or protrusions of the container top 24 may extend all the way through thru-hole openings in the lock 30 to openings in the closure 26. Alternatively, the lock 30 may have, at one or both of the ends 62, one inward directed protrusion and one outward directed protrusion, each configured to be received in a corresponding opening or receiving portion of the container top 24 or closure 26. Alternatively, the lock 30 and/or the closure 26 may be rotatably coupled to the container top 24 using any other suitable mechanism, such as a pin hinge, a living hinge, or other device or system.

The lock 30 is depicted as a carry loop but can instead be implemented in any other suitable manner, provided the lock 30 is movable relative to the container top 24 and the push button 28 to selectively inhibit operation of the push button 28. For example, the lock 30 may include a bar rotatably coupled or slidably coupled to the container top 24 to one side of the push button 28 and with a snap coupler or other coupler to the other side of the push button 28 to selectively retain the lock 30 in the locked position such that the lock 30 may selectively cover, obscure, block, or otherwise inhibit access to and/or operation of the push button 28. Other implementations of the lock 30 within the scope of the instant disclosure are possible.

The button bias member 34 and the closure bias member 36 are depicted in some of the figures as including helical coil springs. The button bias member 34 and the closure bias member 36 may take other forms in other embodiments depending on the implementation. For example, with appropriate modifications to one or more components of the container lid 12, any of the button bias member 34 and the closure bias member 36 may alternatively or additionally be implemented as a metallic spring, a helical coil spring, a torsion spring, a volute spring, a leaf spring, an elastomer spring, a band, or any other suitable bias member configuration.

The container body 14 may be sized and configured to hold, retain and/or store one or more liquids and/or solids. In particular, the container body 14 may include a vessel or bottle used to store liquids such as water, flavored water, vitamin enhanced water, and the like. The container body 14 may also store fluids and solutions such as juices, energy drinks, thirst-quenchers, and other types of beverages. The container body 14 may also be used to store solids such as powders, concentrates, mixes, and foodstuffs.

The container body 14 may be of any suitable size. For example, the container body 14 may hold approximately 8, 12, 16, 20, or 24 ounces (or about 200, 300, 400, 500, 600, 700, 800, 900 ml or a liter). The container body 14 may have any suitable size, including smaller and larger sizes. In addition, the container body 14 may have other shapes and configurations other than those disclosed herein, depending, for example, upon the intended use of the container. Further, the container body 14 may be insulated to help keep the contents at a desired temperature. The container body 14 may be made of plastic, glass, metal, and/or other materials with suitable properties and characteristics.

The container lid 12 may have any suitable size and/or shape that may in general be complementary to the size and shape of the container body 14 at least where the two are coupled together. Further, the container lid 12 may be insulated to help keep the contents within the container body 14 at a desired temperature. The container lid 12 may be made of plastic, glass, metal, and/or other materials with suitable properties and characteristics.

The button bias member 34, the closure bias member 36, the lid seal 32, and/or the lid opening seal 38 may be constructed from materials that are elastic, malleable, flexible, bendable, expandable, and/or resilient. For example, the lid seal 32 and/or the lid opening seal 38 may be constructed from one or more of silicone, polymer, rubber, plastic, or other materials with suitable properties and characteristics. The button bias member 34 and the closure bias member 36 may include and/or be constructed from one or more of silicone, polymer, rubber, plastic, steel or other metal, or other materials with suitable properties and characteristics. The resilience of the lid opening seal 38 may contribute in forming a watertight seal with the lid openings 50.

In some embodiments of the disclosed technology, the container may be used to store, transport, and/or dispense one or more liquids, such as water, beverages, drinks, juices, vitamin enhanced beverages, energy drinks, thirst-quenchers, flavored waters, protein drinks, shakes, foodstuffs, dressings, sauces, liquid meal replacements, solutions, suspensions, and the like. The container may also be used to store, transport, and/or dispense solutions and/or solids such as energy drinks, protein drinks, shakes, liquid meal replacements, etc.

In some embodiments, the container may be a shaker cup and the contents may be shaken, stirred, mixed and/or blended as desired, such as supplements, vitamins, protein powders, etc. This may allow the container to be used to create protein drinks, shakes, smoothies, dressings, sauces, etc. The container may be used as a water bottle in which water and other types of fluids may be transported and/or consumed. The container could further include foodstuffs such as fruits, vegetables, soups, and the like.

Advantageously, in some embodiments, the container may be reusable and refillable, which may allow the container to be used for different purposes over an extended period of time. The container may also be easily carried and portable. For example, the container may be conveniently held in one-hand by the user and/or may have a carry loop. Additionally, the container may be insulated to help keep the contents at a desired temperature, such as at a lower or higher temperature.

In some embodiments, the container may include a small number of parts and components, which may facilitate manufacturing and assembly. In some embodiments, the container may be easily disassembled and cleaned. As discussed elsewhere, the container may include a container lid and/or a closure that allows the container to be easily filled from various sources. The container, container body, and container lid may include any number of parts and components depending, for example, upon the intended use of the container.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as "an aspect" may refer to one or more aspects and vice versa. A phrase such as "an embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such "an embodiment" may refer to one or more embodiments and vice versa. A phrase such as "a configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as "a configuration" may refer to one or more configurations and vice versa.

Pronouns in the masculine (e.g., his) include the feminine and neuter gender (e.g., her and its) and vice versa.

The present disclosure is not to be limited in terms of the particular embodiments described herein, which are intended as illustrations of various aspects. Many modifications and variations can be made without departing from its spirit and scope. Functionally equivalent methods and apparatuses within the scope of the disclosure, in addition to those enumerated herein, are possible from the foregoing descriptions. Such modifications and variations are intended to fall within the scope of this disclosure. Also, the terminology used herein is for the purpose of describing particular embodiments only, and is not intended to be limiting. Moreover, nothing disclosed herein is intended to be dedicated to the public regardless of whether such disclosure is explicitly recited in the above description.

A reference to an element in the singular is not intended to mean "one and only one" unless specifically stated, but rather "one or more." With respect to the use of substantially any plural and/or singular terms herein, the plural terms may include the singular terms and/or the singular terms may include the plural terms as is appropriate to the context and/or application. The various singular/plural permutations may be expressly set forth herein for sake of clarity. The term "some" refers to one or more.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that include A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that include A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

For any and all purposes, such as in terms of providing a written description, all ranges disclosed herein also encompass any and all possible sub ranges and combinations of sub ranges thereof. Any listed range can be easily recognized as sufficiently describing and enabling the same range being broken down into at least equal halves, thirds, quarters, fifths, tenths, and/or others. As a non-limiting example, each range discussed herein can be readily broken down into a lower third, middle third and upper third, etc. All language such as "up to," "at least," and the like include the number recited and refer to ranges which can be subsequently broken down into sub ranges as discussed above. Finally, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, various embodiments of the present disclosure have been described herein for purposes of illustration, and various modifications may be made without departing from the scope and spirit of the present disclosure. Accordingly, the various embodiments disclosed herein are not intended to be limiting.

What is claimed is:

1. A container lid, comprising:

a container top configured to be attached to a container body;

a lid opening formed in the container top;

a closure movably coupled to the container top and configured to selectively cover the lid opening, the closure movable between a first position in which the lid opening is covered and a second position in which the lid opening is uncovered;

a push button movably coupled to one or more of the container top and the closure and configured to selectively retain the closure in the first position, the push button movable with respect to the container top and the closure between a latched position and an unlatched position; and a lock movably coupled to one or more of the container top and the closure between a locked position and an unlocked position, the lock in the locked position configured to inhibit movement of the push button from the latched position to the unlatched position, wherein the lock comprises a carry loop, and wherein, when the lock is in the unlocked position, a portion of the carry loop is spaced apart from the container top.

2. The container lid of claim 1, wherein the lock in the locked position is configured to inhibit movement of the push button from the latched position to the unlatched position by covering at least a portion of the push button.

3. The container lid of claim 2, wherein the at least a portion of the push button comprises at least one of:

an upper half of the push button;

half of a contact portion of the push button that is accessible when the lock is in the unlocked position;

a central axis of the push button; and a centroid of the push button.

4. The container lid of claim 1, wherein the carry loop is rotatably coupled to the container top, the carry loop rotatable to move the lock between the locked position and the unlocked position.

5. The container lid of claim 1, wherein:

the carry loop is rotatably coupled to the container top;

the closure is rotatably coupled to the container top;

the closure comprises a protrusion configured to interfere with rotation of the carry loop relative to the closure passing the protrusion; and the carry loop is rotatable between:

the locked position in which the protrusion of the closure is positioned above at least a portion of the carry loop; and an unlocked position in which the at least a portion of the carry loop is positioned above the protrusion of the closure and in which the closure and the carry loop are independently rotatable relative to the container top.

6. The container lid of claim 5, wherein in the unlocked position the closure and the carry loop are independently rotatable about the same axis, relative to the container top.

7. The container lid of claim 1, wherein:

the carry loop is rotatably coupled to the container top;

the closure is rotatably coupled to the container top;

the closure comprises a protrusion configured to interfere with rotation of the carry loop relative to the closure passing the protrusion; and the carry loop is rotatable between:

the locked position in which the protrusion of the closure is positioned above at least a portion of the carry loop;

a first unlocked position in which the protrusion of the closure engages a receiving portion of the carry loop such that the closure and the carry loop are dependently rotatable relative to the container top; and a second unlocked position in which the at least a portion of the carry loop is positioned above the protrusion of the closure and in which the closure and the carry loop are independently rotatable relative to the container top.

8. The container lid of claim 1, wherein the push button translates and rotates between the latched position and the unlatched position relative to at least one of the container top and the closure.

9. The container lid of claim 1, wherein:

the push button comprises a push button engagement member;

the closure comprises a closure engagement member;

the push button engagement member and the closure engagement member are configured for engagement with each other to selectively retain the closure in the first position;

the push button further comprises a contact portion that is accessible when the lock is in the unlocked position;

a bottom rear of the contact portion is horizontally spaced apart from the container top by a first distance when the push button is in the latched position;

when the push button is in the latched position and the closure is in the first position, the push button engagement member horizontally overlaps the closure engagement member by an engagement distance; and the engagement distance is greater than the first distance.

10. A container, comprising:

a container body;

a container lid attachable to the container body, the container lid comprising:

a spout that provides access to an interior of the container body;

a closure configured to selectively seal the spout, the closure movable relative to the spout between a first position in which the spout is sealed and a second position in which the spout is unsealed;

a push button configured to selectively retain the closure in the first position, the push button movable with respect to at least one of the spout or the closure between a latched position in which the push button holds the closure in the first position and an unlatched position in which the push button does not hold the closure in the first position; and a lock configured to selectively inhibit operation of the push button, the lock movable with respect to the spout between a locked position in which operation of the push button is inhibited by the lock and an unlocked position in which operation of the push button is uninhibited by the lock, wherein the lock comprises a carry loop, and wherein, when the lock is in the unlocked position, a portion of the carry loop is spaced apart from the closure.

11. The container of claim 10, wherein the lock in the locked position is configured to inhibit operation of the push button by inhibiting application of an opening force to at least a portion of the push button.

12. The container of claim 11, wherein the at least a portion of the push button comprises at least one of:

an upper half of the push button;

half of a contact portion of the push button that is accessible when the lock is in the unlocked position;

a central axis of the push button; and a centroid of the push button.

13. The container of claim 10, wherein the carry loop is rotatable relative to the spout, the carry loop rotatable to move the lock between the locked position and the unlocked position.

14. The container of claim 10, wherein:

the carry loop is rotatable relative to the spout;

the closure is rotatable relative to the spout;

the closure comprises a protrusion configured to interfere with rotation of the carry loop relative to the closure passing the protrusion; and the carry loop is rotatable between:

the locked position in which the protrusion of the closure is positioned above at least a portion of the carry loop; and an unlocked position in which the at least a portion of the carry loop is positioned above the protrusion of the closure and in which the closure and the carry loop are independently rotatable relative to the spout.

15. The container of claim 10, wherein the push button translates and rotates between the latched position and the unlatched position relative to at least one of the spout and the closure.

16. The container of claim 10, wherein:

the push button comprises a push button engagement member;

the closure comprises a closure engagement member;

the push button engagement member and the closure engagement member are configured for engagement with each other to selectively retain the closure in the first position;

the push button further comprises a contact portion that is accessible when the lock is in the unlocked position;

a bottom rear of the contact portion is horizontally movable relative to the spout by no more than a first distance;

when the push button is in the latched position and the closure is in the first position, the push button engagement member horizontally overlaps the closure engagement member by an engagement distance; and the engagement distance is greater than the first distance.

17. A container lid comprising:

a container top comprising two pivot mounts spaced apart from each other; and a lock coupled to the container top and rotatable between a locked position in which the lock inhibits opening of the lid, and an unlocked position in which the lock forms a carry loop, wherein a first end of the lock is coupled to the container top at one of the two pivot mounts, and wherein a second end of the lock is coupled to the container top at the other of the two pivot mounts, and wherein the lock inhibits opening of the lid by inhibiting access to a mechanism configured to selectively retain the lid in a closed configuration.

18. The container lid of claim 17, further comprising a closure movable between a first position in which the lid is closed and a second position in which the lid is open, wherein the closure is coupled to the container top at the two pivot mounts, and wherein the closure and the lock are rotatable about the same axis.

19. The container lid of claim 18, wherein the lock can be engaged with and disengaged from the closure, wherein when the lock is engaged with the closure, both the lock and the closure are configured to rotate together about the axis, and wherein when the lock is disengaged from the closure, the lock and the closure are configured to rotate independently about the axis.

20. The container lid of claim 18, wherein the closure is disposed between the first end of the lock and the second end of the lock.

21. The container lid of claim 17, wherein the mechanism is a push button, and wherein in the locked position the lock covers a portion of the push button and inhibits operation of the push button.

22. The container lid of claim 17, further comprising:

a closure movable between a first position in which the lid is closed and a second position in which the lid is open, wherein the closure is biased toward the second position, wherein the push button is movable between a latched position in which the closure when in the first position is retained in the first position, and an unlatched position in which the closure is not retained in the first position, and wherein in the locked position the lock extends around the closure and covers the push button.

23. The container lid of claim 22, wherein when the lock is in the unlocked position, the closure is in the first position, and the button is pushed, the button translates and rotates from the latched position to the unlatched position, and the closure automatically moves from the first position to the second position.

* * * * *